US011719429B2

(12) United States Patent
Gu et al.

(10) Patent No.: US 11,719,429 B2
(45) Date of Patent: Aug. 8, 2023

(54) HEAT DISSIPATION DEVICE AND LIGHTING DEVICE

(71) Applicant: APUTURE IMAGING INDUSTRIES CO., LTD., Guangdong (CN)

(72) Inventors: Haijun Gu, Guangdong (CN); Chongbo Huang, Guangdong (CN); Xiangjun Zhou, Guangdong (CN); Yi Xie, Guangdong (CN)

(73) Assignee: APUTURE IMAGING INDUSTRIES CO., LTD., Guangdong (CN)

( * ) Notice: Subject to any disclaimer, the term of this patent is extended or adjusted under 35 U.S.C. 154(b) by 0 days.

(21) Appl. No.: 17/915,592

(22) PCT Filed: Oct. 10, 2020

(86) PCT No.: PCT/CN2020/120072
§ 371 (c)(1),
(2) Date: Sep. 29, 2022

(87) PCT Pub. No.: WO2021/212764
PCT Pub. Date: Oct. 28, 2021

(65) Prior Publication Data

US 2023/0075501 A1 Mar. 9, 2023

(30) Foreign Application Priority Data

Apr. 24, 2020 (CN) ..... 202020647430.3

(51) Int. Cl.
*F21V 29/76* (2015.01)

(52) U.S. Cl.
CPC ..... *F21V 29/76* (2015.01)

(58) Field of Classification Search
CPC ..... F21V 29/76; F21V 29/74
See application file for complete search history.

(56) References Cited

U.S. PATENT DOCUMENTS

2014/0078737 A1 3/2014 Lin et al.
2016/0305640 A1* 10/2016 Brown ..... F21V 23/003

FOREIGN PATENT DOCUMENTS

CN 101005748 A 7/2007
CN 102137581 A 7/2011
(Continued)

OTHER PUBLICATIONS

International Search Report and the Written Opinion dated Jan. 26, 2021 From the International Searching Authority Re. Application No. PCT/CN2020/120072 and Its Translation of Search Report Into English (3 Pages).

*Primary Examiner* — Thomas M Sember
(74) *Attorney, Agent, or Firm* — Mark M. Friedman

(57) ABSTRACT

Disclosed are a heat dissipation device (140) and a lighting device (10). The heat dissipation device (140) comprises a substrate (141), a plurality of fins (1431) and at least one airflow generating device (145), wherein the plurality of fins (1431) are arranged on the substrate (141) at certain intervals and are connected to the substrate (141); and the at least one airflow generating device (145) is arranged at the ends of the plurality of fins (1431) away from the substrate (141), and an airflow generated by the airflow generating device (145) flows through at least some gaps of the plurality of fins (1431) in the direction of the substrate (141) and is jointly guided by the substrate (141) and the plurality of fins (1431) to be diffused.

15 Claims, 13 Drawing Sheets

(56) References Cited

FOREIGN PATENT DOCUMENTS

| | | | |
|---|---|---|---|
| CN | 204345583 | U | 5/2015 |
| CN | 208546825 | U | 2/2019 |
| CN | 110671686 | A | 1/2020 |
| CN | 110986012 | A | 4/2020 |

* cited by examiner

C

HEAT DISSIPATION DEVICE AND LIGHTING DEVICE

BACKGROUND OF INVENTION

Field of Invention

The present application relates to a field of lighting technology, in particular to a heat dissipation device and a lighting device.

Description of Prior Art

Lighting devices such as light emitting diode (LED) lamps and film and television lamps generally emit light through light sources equipped with the LED lamps. With power of the light sources is more greater, integration of the light sources is more higher, a lot of heat will be generated by the light sources in a process of emitting light. In order to avoid damage to the light sources caused by the heat generated by the light sources, the heat generated by the light sources are generally dissipated by heat dissipation devices.

However, the existing heat dissipation devices have poor heat dissipation effect on the light sources, the heat generated by the light sources can not be timely dissipated, resulting in an unstably work of the lighting devices for a long time.

SUMMARY OF INVENTION

An embodiment of the present application provides a heat dissipation device and a lighting device, which aims to improve heat dissipation devices, so as to improve a heat dissipation effect of the heat dissipation devices, so that when the heat dissipation device is applied into the lighting device, the lighting device can work stably for a long time.

An embodiment of the present application provides the heat dissipation device, which comprises:

a substrate;

a plurality of fins, the plurality of fins arranged on the substrate with certain gaps therebetween and connected to the substrate; and at least one airflow generating device disposed at an end of the plurality of fins away from the substrate, airflow generated by the airflow generating device flowing from at least a part of the gaps of the plurality of fins and along a direction toward the substrate, and the airflow being guided to diffuse through the substrate together with the plurality of fins.

An embodiment of the present application further provides the lighting device, the lighting device comprises:

a light source; and the heat dissipation device described above, wherein the lighting device comprises:

the substrate;

the plurality of fins, the plurality of fins arranged on the substrate with certain gaps therebetween and connected to the substrate; and the at least one airflow generating device disposed at the end of the plurality of fins away from the substrate, the airflow generated by the airflow generating device flowing from at least the part of the gaps of the plurality of fins and along the direction toward the substrate, and the airflow being guided to diffuse through the substrate together with the plurality of fins; and wherein a side of the substrate of the heat dissipation device away from the plurality of fins is thermally connected to the light source.

By disposing the plurality of fins on the substrate, after heat generated by a heat element to be dissipated is absorbed by the substrate, the heat dissipation device provided by the embodiment of the present application can quickly conduct the heat to the plurality of fins. At a same time, by controlling an operation of the airflow generating device located at the end of the fins away from the substrate, the airflow generated from the airflow generating device flow from at least the part of the gaps of the plurality of fins and along the direction toward the substrate, and the airflow is guided to diffuse through the substrate together with the plurality of the fins, then heat generated by the fins and the substrate is taken away, thereby effectively improving a heat dissipation efficiency of the heat dissipation device.

When the heat dissipation device is applied into the lighting device, the side of the substrate away from the plurality of the fins can be connected to the light source of the lighting device, so that heat generated by the light source can be rapidly dissipated by the heat dissipation device, so that the lighting device can work stably for a long time.

BRIEF DESCRIPTION OF DRAWINGS

Technical solutions and other beneficial effects of the present application will be obvious through a detailed description of specific embodiments of the present application in combination with accompanying drawings.

Figure 1:
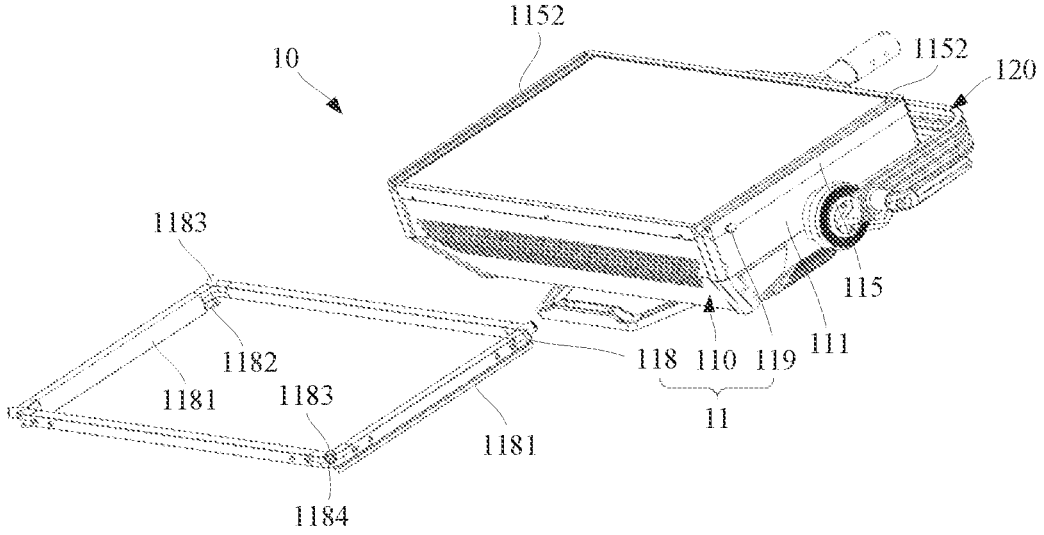
FIG. 1 is a schematic structural diagram of an embodiment of a lighting device provided by an embodiment of the present application, wherein a bracket is not disposed on a housing.

A lighting device 10; a housing 11; a main housing 111; a cavity 1111; a back plate 112; first air inlets 1121; a fixing block 1122; first side plates 113; a clamping plate 1131; second air inlets 1132; air outlets 1133; second side plates 114; an assembly plate 1141; limiting plates 1142; a diffuser installing frame 115; a light outlet 1150; first frames 1151; a chute 1152; a via 1153; a connecting plate 1154; second frames 1155; a clamping groove 1156; a second fixing hole

1157; a diffuser 116; a guide element 117; a guide groove 1171; connecting components 1172; a first fixing hole 1173; a bracket 118; a slide rail 1181; a card slot 1182; a installing column 1183; installing holes 1184; frame bars 1185; a butting surface 1186; an arc-shaped surface 1187; a locating element 119; a connecting rod 1191; an accommodation hole 1192; a clamping component 1193; an elastic element 1194; a limiting portion 1195; a clamping protrusion 1196; a guide surface 1197; a pressing component 1198; a support frame 120; a U-shaped bracket 121; a support plate 122; a third fixing hole 1221; a fixing component 123; fixing elements 1231; a support rod 1232; a light source 130; a heat dissipation device 140; a substrate 141; a strip-shaped groove 1411; sockets 1412; a fourth fixing hole 1413; a second heat dissipation pipe 142; a fin 143; a groove 1430; fins 1431; a baffle 144; a U-shaped plate 1441; a through hole 1442; installing plates 1443; locating protrusions 1444; airflow generating devices 145; a first heat dissipation pipe 146; a first section 1461; a second section 1462; a connecting pipe 1463; a first circuit board 150; locating holes 151; a second circuit board 152; a power adapter 160; a handle 170; a knob 180.

DETAILED DESCRIPTION OF EMBODIMENTS

Technical solutions in embodiments of the present application will be described clearly and completely in combination with drawings in the embodiments of the present application. Obviously, the described embodiments are only part of the embodiments of the present application, not all of them. Based on the embodiments in the present application, all other embodiments obtained by those skilled in the art without creative work belong to the scope of protection in the present application.

In the description of the present application, it should be understood that orientation or position relationships indicated by terms "center", "longitudinal", "transverse", "length", "width", "thickness", "top", "bottom", "front", "back", "left", "right", "vertical", "horizontal", "top", "bottom", "inside", "outside", "clockwise", and "counterclockwise" are based on orientation or position relationships shown in the drawings, which are only for a convenience of describing the present application and simplifying the description, rather than indicating or implying that devices or elements referred to must have a specific orientation, structure, and operation in a specific orientation, so it cannot be understood as a limitation of the present application. In addition, terms "first" and "second" are only used for describing purposes and cannot be understood as indicating or implying relative importance or implicitly indicating a number of indicated technical features. Thus, features defined as "first" and "second" can explicitly or implicitly include one or more of the said features. In the description of the present application, "plurality" means two or more, unless otherwise specified.

In the description of the present application, it should be noted that, unless otherwise specified and defined, terms "installation", "connection", and "connection" should be understood broadly, for example, they can be a fixed connection, a removable connection, or an integrated connection; It can be a mechanical connection, an electrical connection, or a mutual communication; It can be directly connected or indirectly connected through an intermediate media. It can be an internal connection of two components or an interaction between two components. For ordinary technicians in the art, specific meanings of the above terms in the present application can be understood according to specific situations.

In the present application, unless otherwise specified and defined, a first feature is disposed "on" or "below" a second feature can include a direct contact between the first feature and the second feature, or a contact between the first feature and the second feature through other features rather than the direct contact. Moreover, the first feature is disposed "on", "upper", and "up" the second feature include that the first feature is disposed directly above and obliquely above the second feature, or only indicates that a horizontal height of the first feature is higher than a horizontal height of the second feature. The first feature "below" of the second feature include the first feature is disposed directly below and obliquely below the second feature, or only indicate that the horizontal height of the first feature is less than the horizontal height of the second feature.

Following disclosure provides many different embodiments or examples to realize different structures of the present application. In order to simplify the disclosure of the present application, components and arrangements of specific examples will be described below. Of course, they are only examples and are not intended to limit the present application. In addition, the present application can repeat reference numerals and/or reference letters in different examples for a purpose of simplification and clarity, which does not in itself indicate a relationship between various embodiments and/or arrangements discussed. In addition, the present application provides examples of various specific processes and materials, but those skilled in the art can be aware of the present application of other processes and/or use of other materials.

The embodiments of the present application provide a heat dissipation device, a bracket, and a lighting device. Details are as follows.

Figure 2:
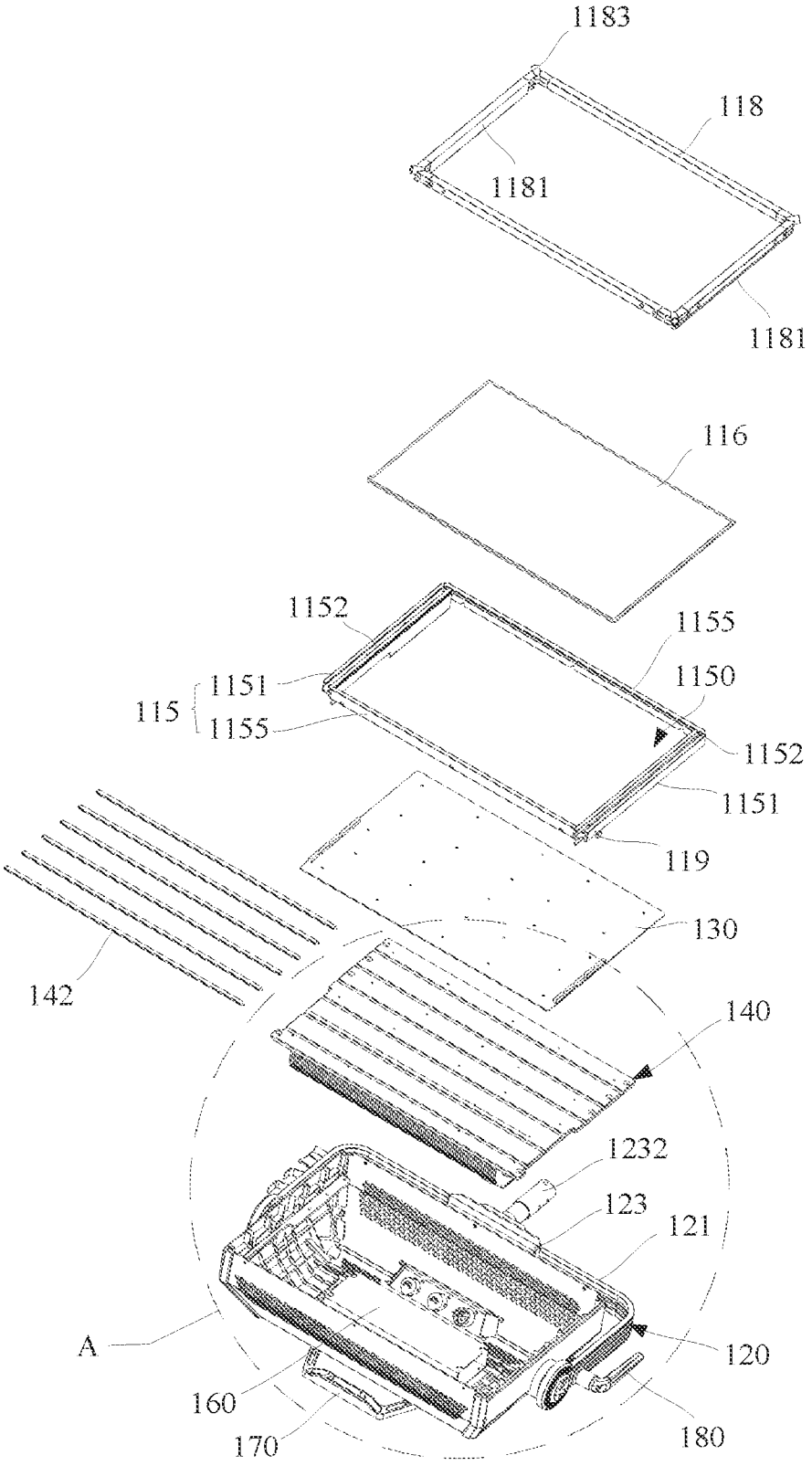
FIG. 2 is a disassembled schematic structural diagram of the lighting device in FIG. 1.

FIG. 1 is a schematic structural diagram of an embodiment of the lighting device provided by an embodiment of the present application, wherein a bracket is not disposed on a housing, and FIG. 2 is a disassembled schematic structural diagram of the lighting device in FIG. 1. As shown in FIG. 1 and FIG. 2, the lighting device 10 includes the housing 11, a light source 130 arranged in the housing 11, and a heat dissipation device 140. The light source 130 is used to emit light, and the light source 130 can be arranged on a light source substrate such as a metal substrate or a ceramic substrate, which has high thermal conductivity. The light source substrate can be provided with a light emitting diode (LED) array, wherein the array includes a plurality of independent light emitting diodes, so as to form a single emitting surface having high brightness light; of course, other types of light sources such as organic light emitting diodes or laser diode arrays are also feasible. The heat dissipation device 140 is thermally connected to the light source 130, so as to dissipate heat generated by the light source 130. Wherein the lighting device 10 can be applied into scenes such as film, television, photography, etc, and there is no limitation here.

Figure 4:
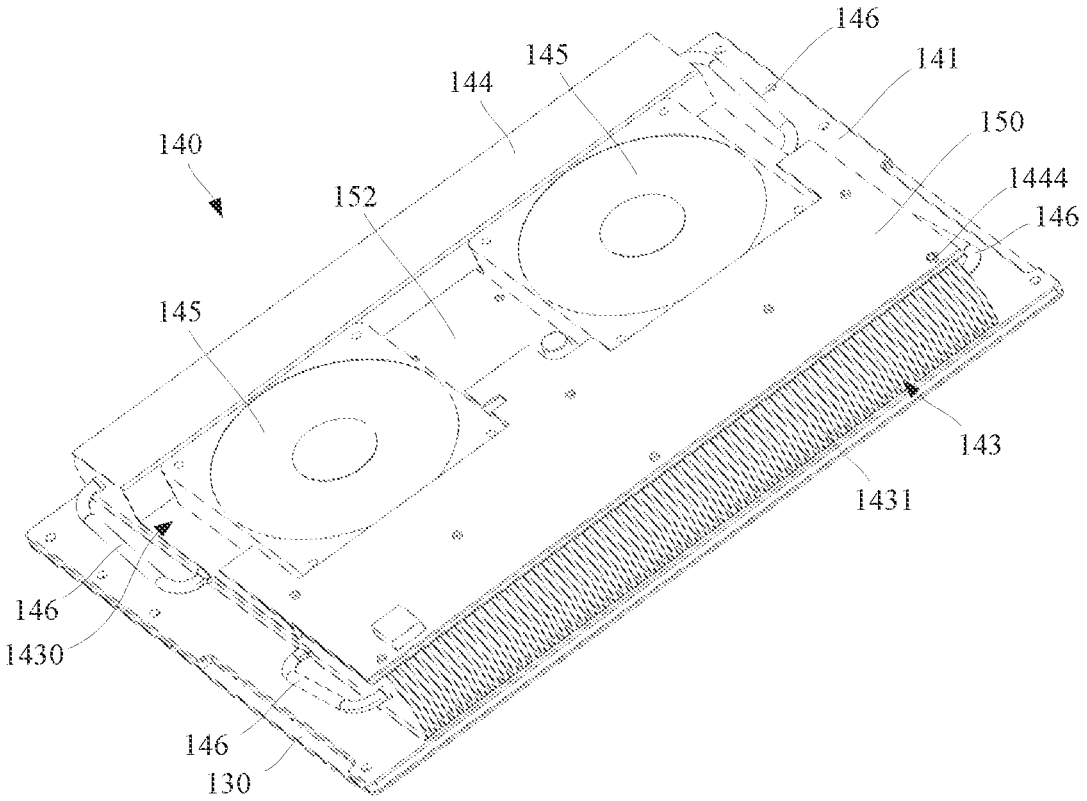
FIG. 4 is a schematic structural diagram of an embodiment of a heat dissipation device provided by the embodiment of the present application.
Figure 5:
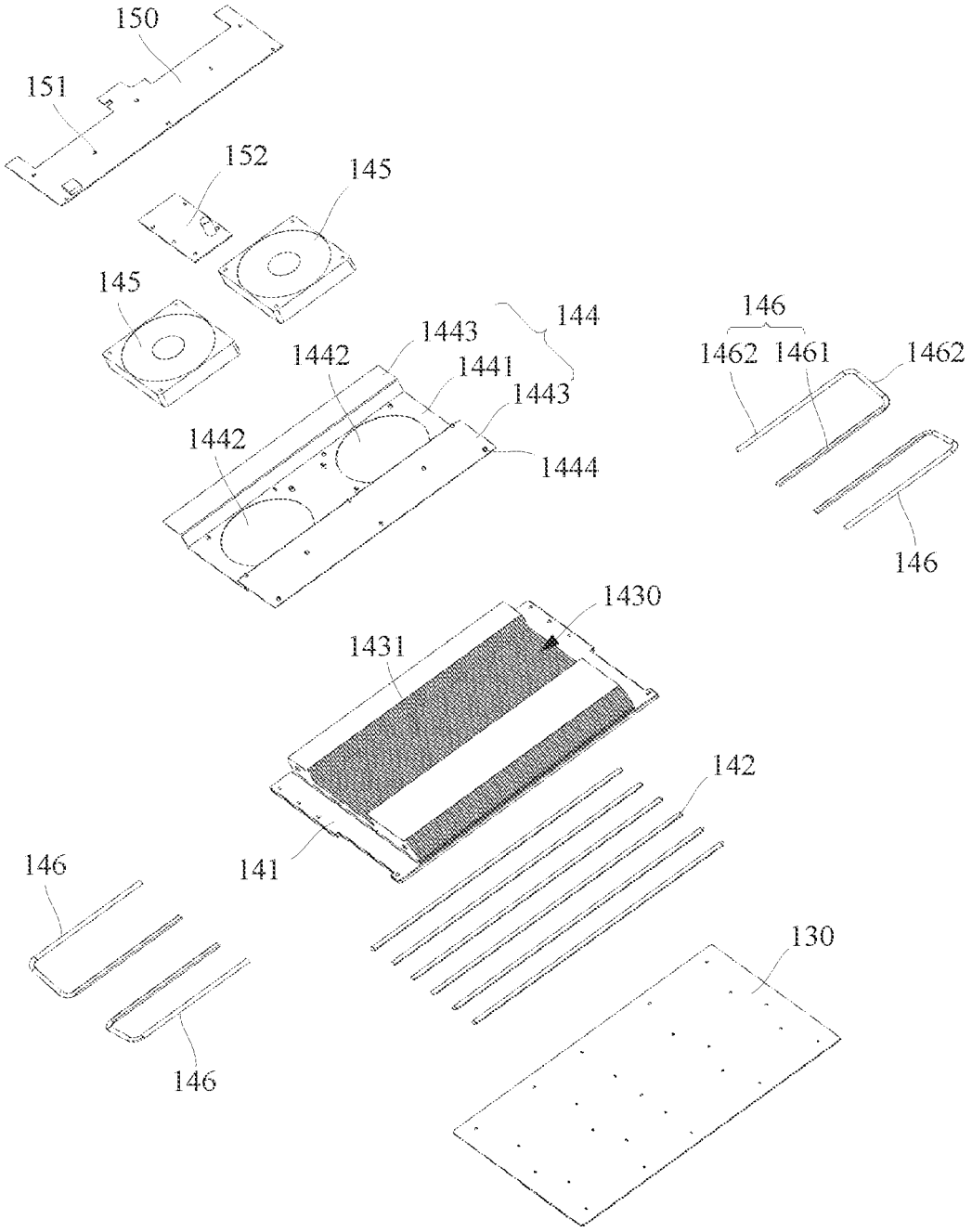
FIG. 5 is a disassembled schematic structural diagram of the heat dissipation device in FIG. 4.

First, the embodiment of the present application provides the heat dissipation device 140, as shown in FIG. 4 and FIG. 5. The heat dissipation device 140 includes a substrate 141, a plurality of fins 1431, and at least one airflow generating device 145. The substrate 141 includes a first side and a second side disposed opposite to each other. The first side of the substrate 141 is used to be thermally connected to a heat element to be dissipated; the plurality of fins 1431 are arranged on the substrate 141 with certain gaps therebetween and are connected to the substrate 141, wherein the plurality of fins 1431 are connected to the second side of the substrate 141, so that heat absorbed by the substrate 141 from the heat element to be dissipated can be conducted to the plurality of fins 1431, and then the heat will be dissipated into the gaps therebetween the plurality of fins 1431 by the plurality of fins 1431. The at least one airflow generating device 145 (for example, a fan, etc.) is arranged at an end of the plurality of fins 1431 away from the substrate 141, an air outlet of the at least one airflow generating device 145 faces the gaps therebetween the plurality of fins 1431. Airflow generated by the airflow generating device 145 flows from at least a part of the gaps of the plurality of fins 1431 and along a direction toward the substrate 141, and the airflow is guided to diffuse through the substrate 141 together with the plurality of fins 1431.

Wherein the substrate 141 can be made of materials having good thermal conductivity such as copper, and the plurality of fins 1431 can be made of materials such as aluminum, wherein a weight of aluminum is less than a weight of copper, which can effectively reduce an overall weight of the fins 1431. Of course, it will be obvious for those skilled in the art that the plurality of fins 1431 can alternatively be made of other suitable materials (having sufficiently high thermal conductivity and a low weight). For example, other metals (such as iron or nickel alloy) can be suitable, or even non-metallic materials (including graphite or other carbon-based materials having high heat conductivity).

The heat element to be dissipated can be the light source 130 or a circuit board, etc. A side (the first side) of the substrate 141 away from the plurality of fins 1431 is thermally connected to the light source 130 or the circuit board, so as to absorb heat generated by the light source 130 in a process of light emission, thereby reducing a temperature of the light source 130.

When the heat dissipation device 140 is applied into the lighting device 10, the airflow generating device 145 can be controlled to operate, so that cold airflow generated by the airflow generating device 145 flows from at least a part of the gaps of the plurality of fins 1431 and along the direction toward the substrate 141, so that the cold airflow flow through a surface of the plurality of fins 1431 and the second side of the substrate 141, and then take away heat generated by the fins 1431 and the substrate 141, thereby effectively improving a heat dissipation efficiency of the heat dissipation device 140.

In the embodiment of the present application, by connecting the plurality of fins 1431 with the second side of the substrate 141, that is, the plurality of fins 1431 are connected to a side of the substrate 141 away from the light source 130, so as to increase a heat dissipation area of the heat dissipation device 140, and then the airflow generating device 145 is used to perform a wind cooling to the fins 143 and the substrate 141, the heat generated by the fins 1431 and the substrate 141 can be quickly taken away, thereby effectively improving the heat dissipation efficiency of the heat dissipation device 140. When the heat dissipation device 140 is applied into the lighting device 10, the side of the light source 130 of the lighting device 10 can be thermally connected to the first side of the substrate 141, so that heat generated by the light source 130 can be rapidly dissipated by the heat dissipation device 140, thereby ensuring a stable work of the lighting device 10 for a long time.

It should be noted that the heat dissipation device 140 can be connected with other types of components to be heat dissipated, in addition to being used for heat dissipation of the light source 130 in the lighting device 100, so as to effectively perform heat dissipation on the heat element to be dissipated.

In some embodiments, as shown in FIG. 5, the plurality of fins 1431 are arranged in parallel, and the plurality of fins 1431 are disposed perpendicular to a second plane of the substrate 141. A side edge of the plurality of fins 1431 close to the substrate 141 is welded and fixed with the second plane of the substrate 141, so that heat can be quickly conducted from the substrate 141 to the plurality of fins 1431.

Bending plates (not shown in the drawings) are formed by bending from an end of the plurality of fins 1431 away from the substrate 141 along a same direction, and a bending direction of the bending plates are consistent with an arrangement direction of the plurality of fins 1431. In the plurality of fins 1431, a bent plate of each of the fins 1431 is fixedly connected to an adjacent one of the fins 1431 along the bending direction of the bending plates, so as to improve structural stability of a fin 143.

Since the gaps are defined therebetween the plurality of fins 1431, an opening is defined by the gaps at the end of the plurality of fins 1431 away from the substrate 141. When the airflow generated by the airflow generating device 145 flows from at least the part of the gaps of the plurality of fins 1431 and along the direction toward the substrate 141, and the airflow is guided to diffuse through the substrate 141 together with the plurality of fins 1431, the airflow will leak out from the opening defined at the end of the plurality of fins 1431 away from the substrate 141, therefore, a heat dissipation effect of the airflow generating device 145 on the plurality of fins 1431 will be affected.

To avoid the above problem, in some embodiments, as shown in FIG. 4 and FIG. 5, the heat dissipation device 140 also includes a baffle 144, the baffle 144 is arranged on the end of the plurality of fins 1431 away from the substrate 141, and covers the plurality of fins 1431, so that the baffle 144 can block at least a part of the opening defined at a side of the plurality of fins 1431 away from the substrate 141. Wherein the airflow generating device 145 is arranged on a side of the baffle 144 away from the plurality of fins 1431, and a through hole 1442 is defined at a position of the baffle 144 corresponding to an air outlet of the airflow generating device 145, so that the airflow generated by the airflow generating device 145 flows from at least the part of the gaps of the plurality of fins 1431 and along the direction toward the substrate 141, and the airflow diffuses out through an end of the fins 1431, thereby improving the heat dissipation effect of the airflow generating device 145 on the fin 143.

Wherein the baffle 144 can be disposed to cover all of the fins 1431, and only the through hole 1442 defined on the baffle 144 exposes a part of the plurality of fins 1431, so that the opening defined on the side of the plurality of fins 1431 away from the substrate 141 can be covered as much as possible.

In some embodiments, as shown in FIG. 4 and FIG. 5, a groove 1430 is also defined at the end of the fins 1431 away from the substrate 141. The at least one airflow generating device 145 is provided in the groove 1430, so as to reduce an overall thickness of the heat dissipation device 140. Wherein the groove 1430 is defined at a middle part in a length direction of the fins 1431.

It can be understood that when the heat dissipation device 140 perform heat dissipation on the heat element to be dissipated, a temperature at a middle part of the substrate 141 will be greater than a temperature at surrounding edges of the substrate 141, and a temperature at a middle part of the fins 1431 will also be greater than a temperature at two ends of the fins 1431. By defining the groove 1430 using for providing the airflow generating device 145 at the middle part of the fins 1431 in the length direction, after the airflow generated by the airflow generating device 145 flows from at least the part of the gaps of the plurality of fins 1431 and along the direction toward the substrate 141, the airflow will flow out along a direction from the middle part to the two ends of the fins 1431, so that heat generated by the middle part of the substrate 141 and the middle part of the fins 1431 can be quickly taken away, thereby improving a cooling effect of the airflow generating device 145 on the fins 1431 and the substrate 141.

It should be noted that the groove 1430 is defined at the middle part of the fins 1431 in the length direction, wherein the groove 1430 can be located at a precise middle part of the fins 1431 in the length direction, or can be located at a position defined by a middle part of the fins 1431 deviating a certain distance toward a certain end of the fins 1431, that is, lengths of the fins 1431 defined at two sides of the groove 1430 are not equal.

In some embodiments, distances between the two ends of the fins 1431 and the groove 1430 defined at the middle part of the fins 1431 are not equal, and an installing area for installing a first circuit board 150 can be defined between the groove 1430 and an end of the fins 1431 farther away.

In some embodiments, the above at least one airflow generating device 145 includes a plurality of airflow generating devices 145, and the plurality of airflow generating devices 145 are distributed in sequence along an arrangement direction of the plurality of fins 1431, so as to ensure that an installation of airflow entering the gaps therebetween the plurality of fins 1431 is sufficient. At a same time, a diameter of each of the airflow generating devices 145 can be defined smaller, and a width of the groove 1430 defined on the fins 1431 can be reduced accordingly, thus, an area of each of the fins 1431 can be increased, thereby improving a heat dissipation effect of the fins 1431.

Specifically, as shown in FIG. 4 and FIG. 5, a rectangular notch is defined at a side of a middle part of each of the fins 1431 away from the substrate 141. The notches defined on the plurality of fins 1431 defines a rectangle-shaped groove 1430. The baffle 144 covers the side of the plurality of fins 1431 away from the substrate 141, and the baffle 144 includes a U-shaped plate 1441 adapted to the groove 1430 and installing plates 1443 connected to two side edges of the U-shaped plate 1441, wherein the two installing plates 1443 cover bending plates of the plurality of fins 1431. Heights of the airflow generating devices 145 can be equal to a height of the installing plates 1443 or be less than the height of the installing plates 1443; of course, the heights of the airflow generating devices 145 can also be greater than the height of the installing plates 1443 if a thickness problem is not considered. The installing plates 1443 is provided with a plurality of locating protrusions 1444, locating holes 151 are defined at a position of the first circuit board 150 corresponding to the locating protrusions 1444; the first circuit board 150 is disposed on the installing plates 1443, and the locating protrusions 1444 located on the installing plates 1443 are inserted into the locating holes 151 defined in the first circuit board 150, so as to locate the first circuit board 150. Of course, in order to make heat dissipation of the first circuit board 150 better and fixation more stable, the first circuit board 150 can also be glued to the installing plates 1443. Wherein the locating protrusions 1444 located on the installing plates 1443 can be formed by pressing the installing plates 1443, or the locating protrusions 1444 can be fixed on the installing plates 1443 by a welding or pasting method.

The U-shaped plate 1441 covers a bottom surface and two opposite sides of the groove 1430, two through holes 1442 are defined at a bottom part of the U-shaped plate 1441, and the two through holes 1442 are distributed in sequence along the arrangement direction of the plurality of fins 1431. A number of the airflow generating devices 145 is two, the two airflow generating devices 145 are disposed at the bottom part of the U-shaped plate 1441 and are directly opposite to the two through holes 1442. Wherein the airflow generating devices 145 can be axial flow fans, an air inlet and an air outlet of each of the axial flow fans are distributed along a rotation axis of fan blades itself, the air outlet of each of the axial flow fans faces the through holes 1442 defined in the U-shaped plate 1441, and the air inlet of each of the axial flow fans is defined at a side of the axial flow fans away from the U-shaped plate 1441.

The U-shaped board 1441 is also provided with a second circuit board 152, the second circuit board 152 is located between the two through holes 1442, and a installing method of the second circuit board 152 and the bottom part of the U-shaped board 1441 can refer to a installing method of the first circuit board 150, which will not be repeated here.

In some embodiments, as shown in FIG. 4 and FIG. 5, the heat dissipation device 140 also includes at least one first heat dissipation pipe 146, the at least one first heat dissipation pipe 146 passes through the plurality of fins 1431 in sequence, so as to conduct heat generated by the middle part of the plurality of fins 1431, thereby improving the heat dissipation efficiency of the fins 1431. Wherein the first heat dissipation pipe 146 includes a first section 1461 and a second section 1462 connected to each other and passing through the plurality of fins 1431 in sequence along a distribution direction of the plurality of fins 1431, and the first section 1461 and the second section 1462 of the first heat dissipation pipe 146 are distributed in sequence along a direction from the middle part to the end of the fins 1431.

Since a temperature at the middle part of the fins 1431 is higher than a temperature at the two ends of the fins 1431, by enabling the first section 1461 and the second section 1462 of the first heat dissipation pipe 146 to be distributed in sequence along the direction from the middle part to the end of the fins 1431, so that heat generated by a part close to the middle part of the fins 1431 can be conducted to the first section 1461 of the first heat dissipation pipe 146, then the heat is conducted from the first section 1461 to the second section 1462, and finally, the heat is conducted from the second section 1462 to a part close to the end of the fins 1431. Therefore, the heat generated by the middle part of the fins 1431 can be conducted faster, thereby improving the heat dissipation efficiency of the fins 1431.

Wherein a side surface of the first section 1461 of the first heat dissipation pipe 146 can be attached to the second side surface of the substrate 141. Therefore, the first heat dissipation pipe 146 can also absorb heat generated by the substrate 141, and to dissipate the heat generated by the substrate 141.

Specifically, the first section 1461 and the second section 1462 of the first heat dissipation pipe 146 are both straight pipes, and a U-shaped pipe structure is formed by connecting an end of the first section 1461 with an end of the second section 1462 through a connecting pipe 1463. Both of a free end of the first section 1461 and a free end of the second section 1462 of the first heat dissipation pipe 146 pass through the plurality of fins 1431 in sequence from an end of the substrate 141 along the arrangement direction of the plurality of fins 1431; and the first section 1461 of the first heat dissipation pipe 146 is located at the middle part of the fins 1431, a second end of the first heat dissipation pipe 146 is disposed close to the end of the fins 1431, and the connecting pipe 1463 is located outside the plurality of fins 1431.

It should be noted that the first section 1461 of the first heat dissipation pipe 146 is located at the middle part of the fins 1431, wherein the first section 1461 can be located at a precise middle part of the fins 1431 in the length direction, or can be located at a position defined by the precise middle part of the fins 1431 deviating a certain distance.

Wherein a cross-sectional shape of the first section 1461 of the first heat dissipation pipe 146 is rectangular, and a side of the first section 1461 is attached to the second side of the substrate 141, so as to increase a contacting area between the first section 1461 of the first heat dissipation pipe 146 and the substrate 141, thereby improving a heat conducting efficiency between the substrate 141 and the first section 1461 of the first heat dissipation pipe 146.

A cross-sectional shape of the second section 1462 of the first heat dissipation pipe 146 and a cross-sectional shape of the connecting pipe 1463 can be circular, square, or other shapes, and there is no restriction here.

In some embodiments, the above at least one first heat dissipation pipe 146 can include a plurality of first heat dissipation pipes 146, and the plurality of first heat dissipation pipes 146 are distributed in sequence along the length direction of the fins 1431. The plurality of first heat radiating pipes 146 can guide the heat generated by the middle part of the fins 1431 to the two ends of the fins 1431 at a same time, so as to improve the heat dissipation efficiency of the fins 1431.

Specifically, the heat dissipation device 140 includes four first heat dissipation pipes 146, two first heat dissipation pipes 146 are arranged at each of two ends of the substrate 141 along the arrangement direction of the plurality of fins 1431, and the two first heat dissipation pipes 146 located at each of the two ends of the substrate 141 are distributed along the length direction of the fins 1431. Wherein first sections 1461 of the two first heat dissipation pipes 146 are both located below the groove 1430, and second sections 1462 of the two first heat dissipation pipes 146 are arranged close to the two ends of the fins 1431, respectively.

Figure 3:
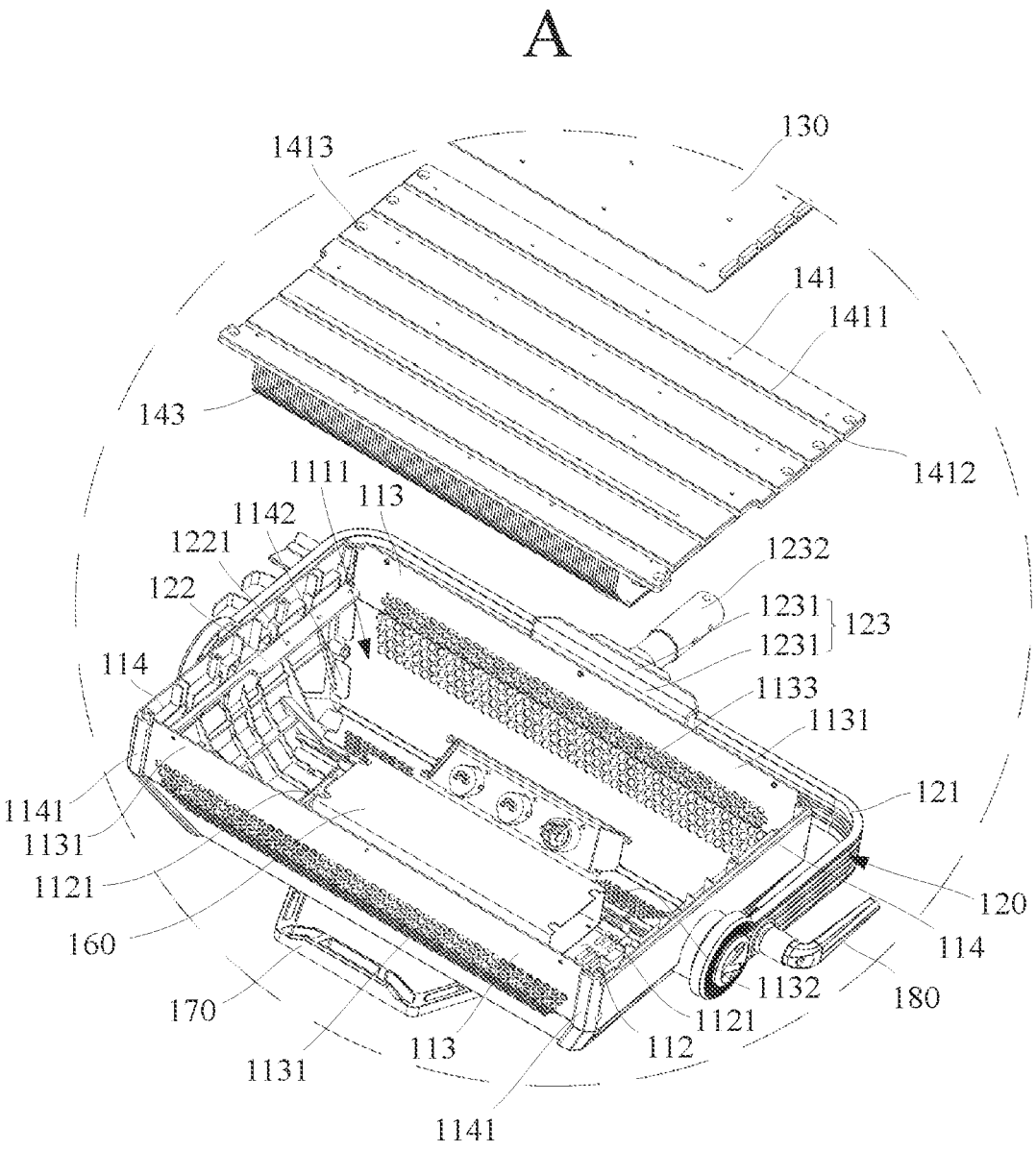
FIG. 3 is an enlarged view at a position of A in FIG. 2.

In some embodiments, as shown in FIG. 2 and FIG. 3, at least one strip-shaped groove 1411 is defined by recessed from a side (the first side) of the substrate 141 away from the plurality of fins 1431, the at least one strip-shaped groove 1411 extends along the arrangement direction of the plurality of fins 1431, and a second heat dissipation pipe 142 is provided in the at least one strip-shaped groove 1411. Therefore, the second heat dissipation pipe 142 can conduct heat generated by a middle part of the substrate 141 to an end of the substrate 141 and an end of the second heat dissipation pipe 142, so that the heat generated by the middle part of the substrate 141 can be conducted more quickly.

Wherein the above at least one strip-shaped groove 1411 can include a plurality of strip-shaped grooves 1411, and the plurality of strip-shaped grooves 1411 are distributed in sequence along the length direction of the fins 1431. Each of the plurality of strip-shaped grooves 1411 is provided with the second heat dissipation pipe 142, so as to improve a heat dissipation effect of the second heat dissipation pipe 142 on the substrate 141.

Specifically, the substrate 141 is a rectangular plate made of aluminum alloy by a smooth processing. Six strip-shaped grooves 1411 are defined on the first side of the substrate 141, and the six strip-shaped grooves 1411 are evenly distributed along the length direction of the fins 1431, the six strip-shaped grooves 1411 pass through the entire substrate 141 along the arrangement direction of the plurality of fins 1431, and sockets 1412 are defined on a side surface of the substrate 141, wherein an end of each of six second heat dissipation pipes 142 is inserted into a corresponding strip-shaped groove 1411 from a corresponding one of the sockets 1412 of the six strip-shaped grooves 1411.

Wherein a rabbet of the strip-shaped groove 1411 is defined at the first side of the substrate 141, and a part of the second heat dissipation pipe 142 is exposed at a position the rabbet is located, and is flush with the first side of the substrate 141. Therefore, when the first side surface of the substrate 141 is connected to the heat element to be dissipated, the second heat dissipation pipe 142 can also be connected to the heat element to be dissipated, so that heat generated by the heat element to be dissipated can be dissipated directly.

In addition, the strip-shaped groove 1411 is closely matched with the second heat dissipation pipe 142, so that the strip-shaped groove 1411 can be attached more closely to an outer surface of the second heat dissipation pipe 142, so that heat conduction of the substrate 141 is faster and more uniform, and at a same time, it is easier for heat generated by the substrate 141 to be conducted to the second heat dissipation pipe 142. It should be understood that after the strip-shaped groove 1411 is closely matched with the second heat dissipation pipe 142, a side surface of the substrate 141 defined with the strip-shaped groove 1411 is still a flat surface, which can facilitate a thermal connection with the light source.

In some embodiments, the first heat dissipation pipe 146 and the second heat dissipation pipe 142 can be made of materials having good thermal conductivity, such as copper, or be made of materials such as aluminum, which has a weight less than a weight of copper, so as to effectively reduce an overall weight. Of course, it will be obvious for those skilled in the art that the first heat dissipation pipe 146 and the second heat dissipation pipe 142 can alternatively be made of other suitable materials (having sufficiently high thermal conductivity and low weights). For example, other metals (such as iron or nickel alloy) can be suitable, or even non-metallic materials (including graphite or other carbon-based materials having high thermal conductivity).

In some embodiments, the light source 130 of the lighting device 10 includes a light source substrate, and a LED array arranged on a side of the light source substrate. A side of the light source substrate away from the LED array is attached to the first side of the substrate 141 through thermal conductive silicone grease (glue), so that heat generated by the light source 130 is conducted to the heat dissipation device 140. Of course, the light source substrate and the substrate 141 can be further fixed with screws, etc.

Wherein during an assembly process, a side of a light source plate away from LED lamps or a side of the substrate 141 facing the light source 130 can be coated with thermal conductive silicone grease, the thermal conductive silicone grease is sandwiched between the light source plate and the substrate 141, since the thermal conductive silicone grease can quickly conduct heat generated by the light source plate to the substrate 141, thereby improving a heat dissipation effect on the light source 130.

The embodiment of the present application also provides a bracket 118, as shown in FIG. 1 and FIG. 2. The lighting device 10 includes the light source 130, a housing 11, and the bracket 118. The bracket 118 is used to support a light soften-light box (not shown in the drawings, the light soften-light box can also be a light soft cloth or a light diffuser, etc.) or other structures capable of softening light emitted by the light source 130. The light source 130 is arranged in the housing 11, and a light outlet 1150 is defined in the housing 11, the light outlet 1150 is disposed opposite to the light source 130, light emitted by the light source 130 shines outside the housing 11 through the light outlet 1150. The bracket 118 is connected to the housing 11, so as to support the light soften-light box on the housing 11 and enable the light soften-light box to be opposite to the light source 130, so as to perform a softening treatment on the light emitted by the light source 130.

In order to facilitate an installation of the light soften-light box of the lighting device 10 on the housing 11, as shown in FIG. 1 and FIG. 2, a chute 1152 is defined at each of two opposite sides of the light outlet 1150 of the housing 11; a slide rail 1181 is defined at each of two opposite sides of the bracket 118 and is connected to the corresponding chute 1152 in a sliding way. By inserting an end of two slide rails 1181 defined on the bracket 118 into two corresponding chutes 1152, the bracket 118 can be connected to the housing 11 together, and by enabling the light soften-light box located on the bracket 118 to correspond to a position of the light outlet 1150, so that the light soften-light box can perform a softening treatment on light emitted by the light source 130.

Wherein the lighting device 10 also includes a locating element 119, the locating element 119 is arranged on the housing 11 and is connected to the bracket 118 when the bracket 118 is installed on the housing 11, so as to locate the bracket 118 and prevent the bracket 118 from separating from the housing 11.

It should be noted that the locating element 119 can only be disposed corresponding to one of the two slide rails 1181, or the locating element 119 can be disposed corresponding to each of the two slide rails 1181 at a same time, and two locating elements 119 can locate the two slide rails 1181, respectively.

Figure 6:
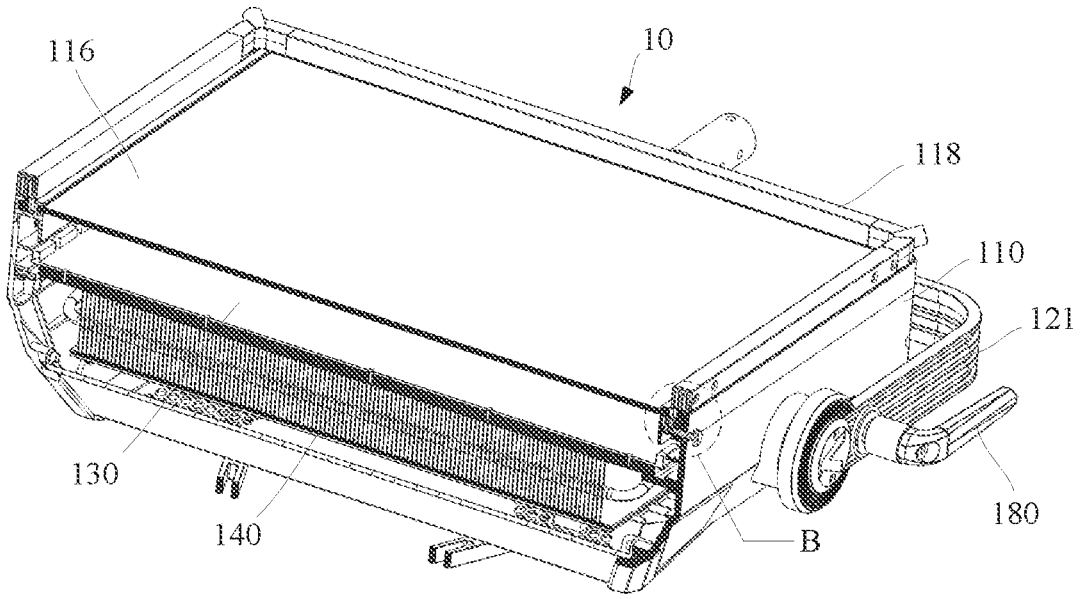
FIG. 6 is a sectional view of the lighting device in FIG. 1, wherein the bracket is disposed on the housing.
Figure 7:
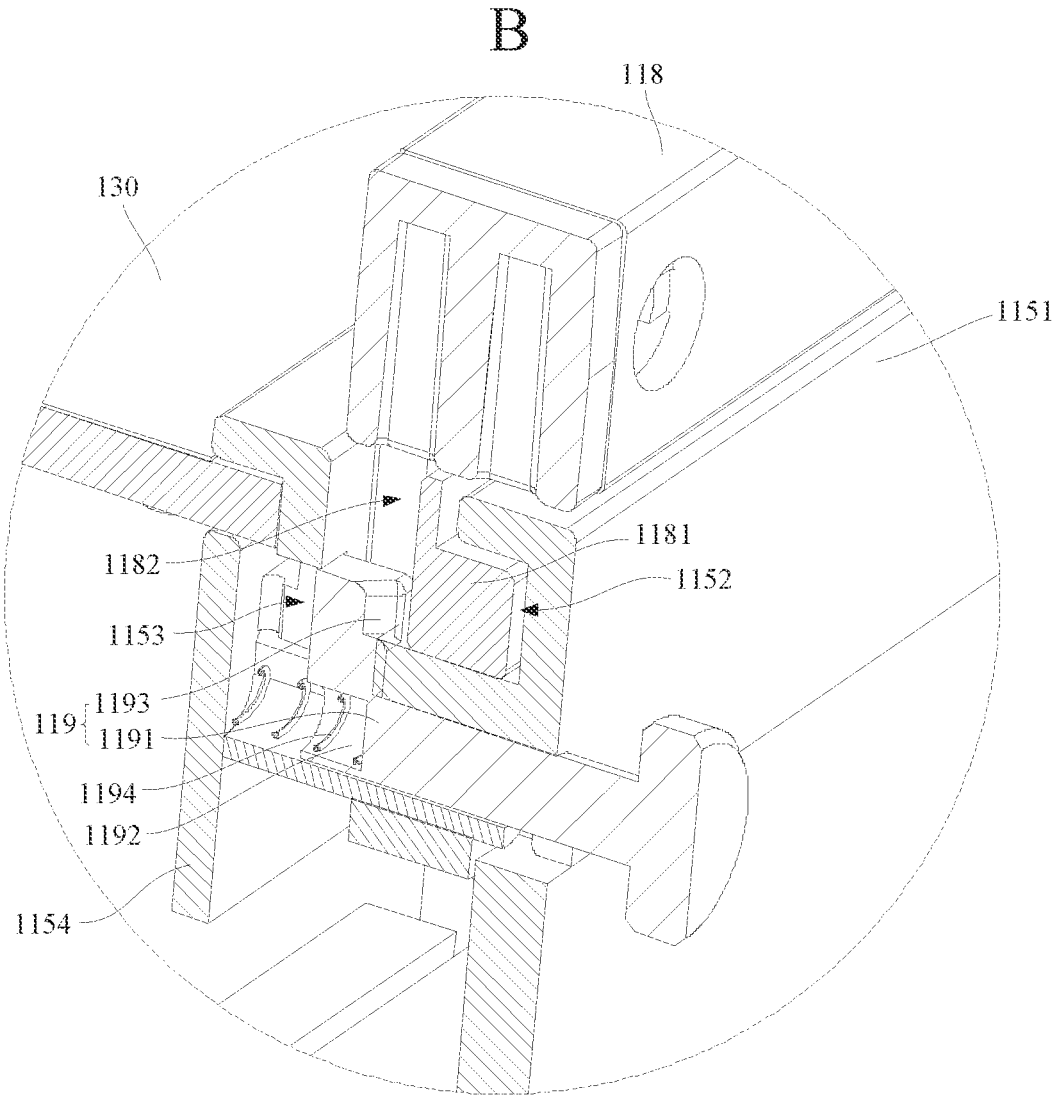
FIG. 7 is an enlarged view at a position of B in FIG. 6.

In some embodiments, as shown in FIG. 6 to FIG. 9, at least one of the slide rails 1181 is provided with a card slot 1182, and a clamping component 1193 is disposed on the locating element 119, the locating element 119 corresponds to the card slot 1182 defined on the slide rail 1181. A part of the locating element 119 extends out of the outer surface of the housing 11, and the locating element 119 is connected to the housing 11 in a sliding way, so that a first position of the clamping component 1193 is defined to avoid the slide rail 1181, and a second position of the clamping component 1193 used for inserting the card slot 1182 is defined to block the slide rail 1181 (positions of the locating element 119 as shown in FIG. 6 and FIG. 7).

Before inserting the slide rail 1181 of the bracket 118 into the corresponding chute 1152 defined on the housing 11, the locating element 119 can be controlled to slide relative to the housing 11, so that the clamping component 1193 disposed on the locating element 119 is at the first position, so as to avoid the slide rail 1181, so that the slide rail 1181 of the bracket 118 can be smoothly inserted into the chute 1152 defined on the housing 11. When the bracket 118 slides to a preset position, by controlling the locating element 119 to slide relative to the housing 11, the clamping component 1193 disposed on the locating element 119 is at the second position, so that the clamping component 1193 is inserted into the card slot 1182 of the slide rail 1181, which can block the slide rail 1181 disposed on the bracket 118, and prevent the bracket 118 and the slide rail 1181 of the bracket 118 from sliding relative to the housing 11, so as to ensure a stable connection between the bracket 118 and the housing 11, thereby preventing the housing 11 from separating from the bracket 118.

Wherein a part of the locating element 119 can extend out of the outer surface of the housing 11, so that the locating element 119 can be manually controlled to slide relative to the housing 11, which makes a structure of the locating element 119 simpler, and makes an installation of the light soften-light box connected to the bracket 118 of the lighting device 10 simpler and more convenient.

In some embodiments, as shown in FIG. 7, a cross-sectional shape of the slide rail 1181 disposed on the bracket 118 is a "L"-shaped, and a cross-sectional shape of the chute 1152 defined on the housing 11 matches the shape of the slide rail 1181. Therefore, when the slide rail 1181 disposed on the bracket 118 is inserted into the chute 1152 defined on the housing 11 and the slide rail 1181 is not located by the locating element 119, the slide rail 1181 can only slide along an extension direction of the chute 1152.

Figure 8:
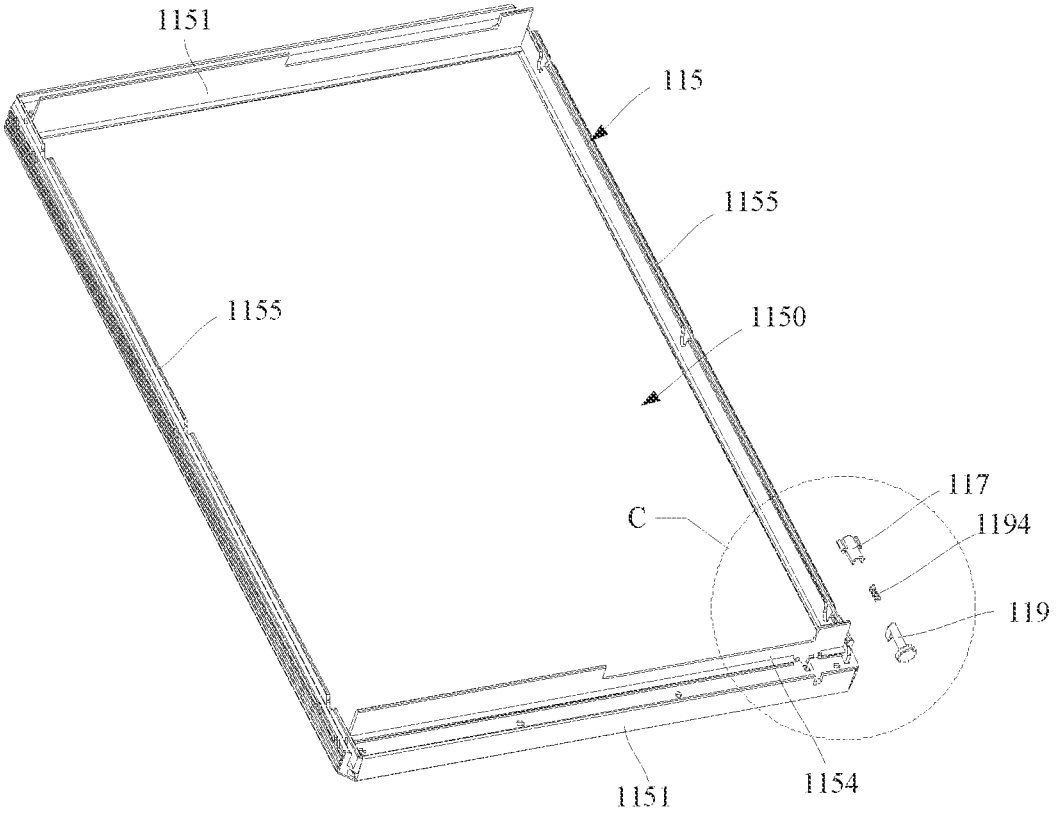
FIG. 8 is a schematic structural diagram of an embodiment of a diffuser installing frame and a locating element provided by the embodiment of the present application.
Figure 9:
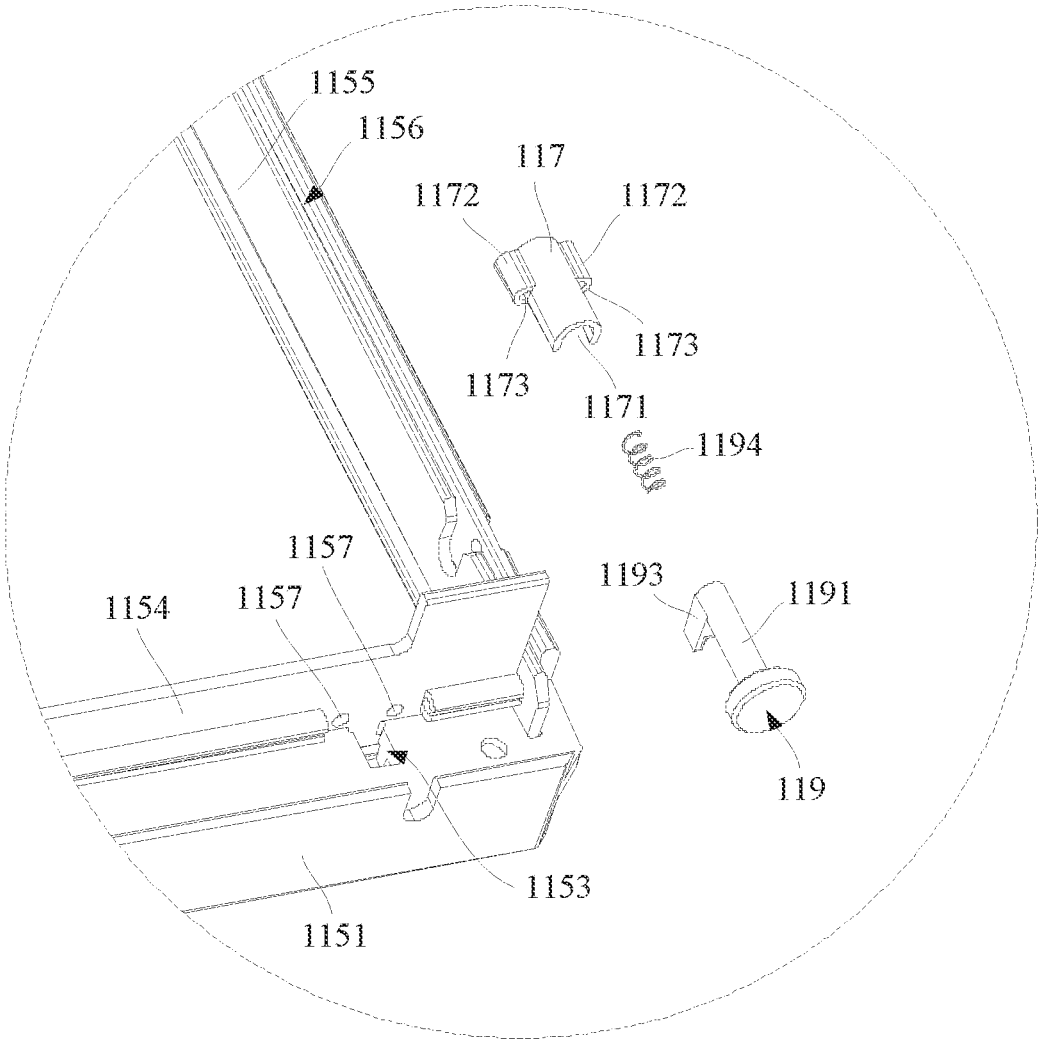
FIG. 9 is an enlarged view at a position of C in FIG. 8.

In some embodiments, as shown in FIG. 7, FIG. 8, and FIG. 9, the lighting device 10 also includes an elastic element 1194, one end of the elastic element 1194 is connected to the housing 11, and another end of the elastic element 1194 is connected to the locating element 119, so as to apply an elastic force using for making the locating element 119 slide from a first position to a second position.

Before inserting the slide rail 1181 of the bracket 118 into the corresponding chute 1152, the locating element 119 can be manually pressed to make the locating element 119 slide relative to the housing 11, so that the clamping component 1193 disposed on the locating element 119 is at the first position, so as to avoid the slide rail 1181, and so that the slide rail 1181 of the bracket 118 can be smoothly inserted into the corresponding chute 1152 defined on the housing 11. When the bracket 118 slides to a preset position, the locating element 119 can be loosened, then the locating element 119 automatically slides to the second position under an action of the elastic element 1194, and the clamping component 1193 disposed on the locating element 119 is inserted into the card slot 1182 of the slide rail 1181, so as to block the slide rail 1181 disposed on the bracket 118.

Wherein when the locating element 119 is not pressed manually, acting force applied by the elastic element 1194 on the locating element 119 can make the clamping component 1193 disposed on the locating element 119 always insert into the card slot 1182 stably, which can improve a locating effect of the locating element 119 on the bracket 118 and the slide rail 1181.

It should be noted that an elastic force applied by the elastic element 1194 on the locating element 119 can be either a thrust force or a tension force, as long as the elastic force can make the locating element 119 slide from the first position to the second position.

As shown in FIG. 2 and FIG. 3, the housing 11 includes a main housing 111 for accommodating the light source 130, and a diffuser installing frame 115 connected to the main housing 111 and defined with the light outlet 1150. The diffuser installing frame 115 is used to install a diffuser 116 at a position the light outlet 1150 is located, and the diffuser 116 is used to perform a preliminary subdued light treatment on light emitted by the light source 130.

Wherein the diffuser installing frame 115 has two opposite first frames 1151, the light outlet 1150 is located between the two first frames 1151, and the chute 1152 is defined at a side of each of the two first frames 1151 away from the main housing 111, so that the chute 1152 defined on the housing 11 is located on a surface of the housing 11, so that it is convenient for the slide rail 1181 disposed on the bracket 118 to be inserted into the corresponding chute 1152 defined on the housing 11.

The locating element 119 is connected to a side of the first frames 1151 facing the main housing 111 in a sliding way, so that in a process of enabling the sliding rail 1181 disposed on the bracket 118 to insert into the corresponding chute 1152 defined on the housing 11, the locating element 119 will not interfere with the sliding rail 1181.

In some embodiments, as shown in FIG. 7, FIG. 8, and FIG. 9, a via 1153 is defined on an inner wall of a side of the chute 1152 close to the light outlet 1150, an included angle is defined between a sliding direction of the locating element 119 and an extension direction of the chute 1152, and the clamping component 1193 is disposed corresponding to a position of the via 1153. Wherein the included angle defined by the sliding direction of the locating element 119 and the extension direction of the chute 1152 can be an acute angle or a right angle, so that the sliding direction of the locating element 119 crosses the extension direction of the chute 1152. By controlling the locating element 119 to slide relative to the first frames 1151, the clamping component 1193 can pass through the via 1153 and extend into the chute 1152, so that the clamping component 1193 can be inserted into the card slot 1182 defined on the slide rail 1181, so as to locate the slide rail 1181; alternatively, the clamping component 1193 can exit from the via 1153 to dodge the slide rail 1181, so that the slide rail 1181 can be smoothly inserted into the chute 1152 or be taken out from the chute 1152.

Correspondingly, the card slot 1182 can be defined by recessed from a surface of a side of the slide rail 1181 close to the light outlet 1150, so that the clamping component 1193 can be inserted into the card slot 1182 after passing through the via 1153.

In some embodiments, as shown in FIG. 9, a guide element 117 is connected to a side of the first frames 1151 facing the main housing 111, and the locating element 119 is connected to the first frames 1151 through the guide element 117 in a sliding way. Therefore, it is unnecessary to define a guide groove 1171 structure slidably connected to the guide element 117 disposed on the first frames 1151, thereby simplifying a structure of the first frames 1151, and making a processing of the first frames 1151 more convenient.

Wherein the guide groove 1171 is defined on the guide element 117, and an included angle is defined between an extension direction of the guide groove 1171 and an extension direction of the chute 1152. The locating element 119 includes a connecting rod 1191 slidably connected to the guide groove 1171, the clamping component 1193 of the guide element 117 is connected to an end of the connecting rod 1191 close to the light outlet 1150. The connecting rod 1191 can slide along the extension direction of the guide groove 1171, so that the clamping component 1193 connected to the connecting rod 1191 is accurately inserted into the via 1153 or is withdrawn from the via 1153. Wherein the included angle defined by the extension direction of the guide groove 1171 and the extension direction of the chute 1152 can be an acute angle or a right angle, so that a sliding direction of the locating element 119 along the guide groove 1171 crosses the extension direction of the chute 1152.

Wherein an end of the connecting rod 1191 away from the clamping component 1193 can extend to a surface of a side of the first frames 1151 away from the light outlet 1150, so that the connecting rod 1191 can be pressed manually, so as to make the connecting rod 1191 slide relative to the first frames 1151.

In some embodiments, as shown in FIG. 7 and FIG. 9, a side of the first frames 1151 facing the main housing 111 extends out to form a connecting plate 1154, and the guide element 117 is fixedly connected to a side of the connecting plate 1154 away from the light outlet 1150, so that a fixing of the guide element 117 is more convenient.

Wherein one end of the elastic element 1194 can be butted with the connecting plate 1154, and another end of the elastic element 1194 can be butted with an end of the connecting rod 1191 close to the light outlet 1150, so as to make an installation of the elastic element 1194 more convenient, and an elastic force applied by the elastic element 1194 on the connecting rod 1191 can be more stable.

In some embodiments, an accommodation hole 1192 is defined by recessed from an end surface of an end of the connecting rod 1191 close to the light outlet 1150, and another end of the elastic element 1194 is inserted into the accommodation hole 1192 and is butted with a bottom surface of the accommodation hole 1192, so that the elastic element 1194 is more stably connected to the connecting rod 1191. Wherein the elastic element 1194 can be a spring, rubber, etc., which is not limited here.

Figure 10:
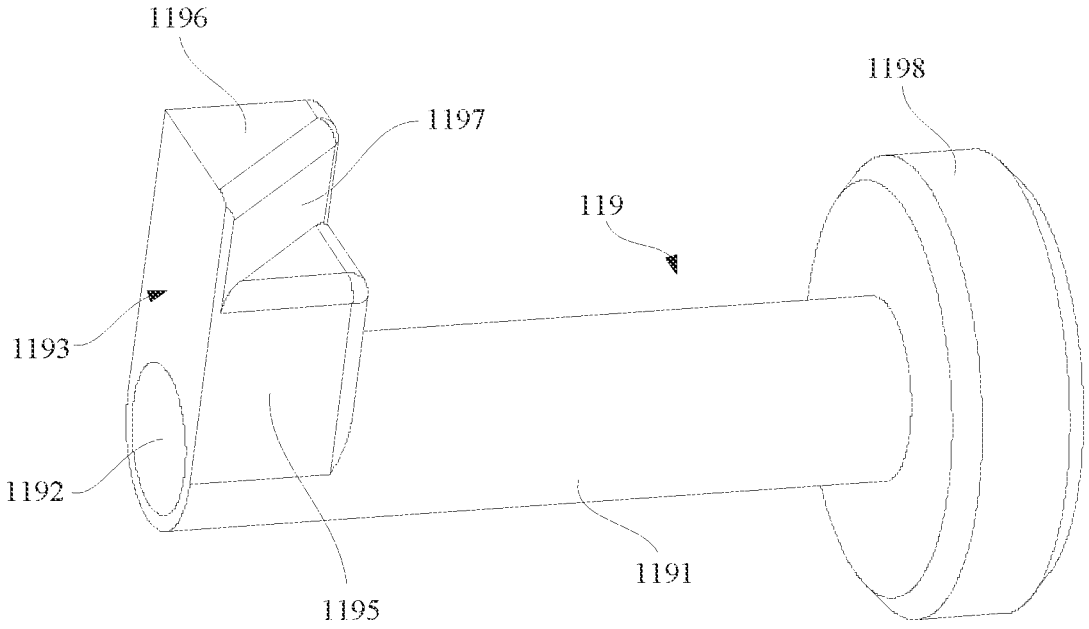
FIG. 10 is a schematic structural diagram of an embodiment of the locating element provided by the embodiment of the present application.

Specifically, as shown in FIG. 10, the connecting rod 1191 of the locating element 119 is a straight rod. One end of the connecting rod 1191 is provided with the clamping component 1193, and another end of the connecting rod 1191 is connected to a pressing component 1198. The pressing component 1198 extends out of the outer surface of the housing 11, and the locating element 119 can be pushed to slide as a whole by a manual pressing to the pressing component 1198.

The clamping component 1193 includes a limiting portion 1195 extending from a peripheral wall of the connecting rod 1191, and a clamping protrusion 1196 arranged on an end of the limiting portion 1195 away from the connecting rod 1191. When the locating element 119 is installed on the housing 11, the limiting portion 1195 disposed on the locating element 119 is matched with two opposite walls of the via 1153, so as to prevent the locating element 119 from rotating around an axis of the connecting rod 1191.

The clamping protrusion 1196 disposed on the limiting portion 1195 is used for inserting into the card slot 1182 of the slide rail 1181, so as to block the slide rail 1181. Wherein a side of the clamping protrusion 1196 is defined with a guide surface 1197, the guide surface 1197 inclines inward along a direction from the clamping component 1193 to the pressing component 1198. When the slide rail 1181 is inserted into the chute 1152, the slide rail 1181 will abut with the guide surface 1197 and apply a force on the guide surface 1197, wherein the force is perpendicular to the guide surface 1197, and has a component force along a direction from the pressing component 1198 to the clamping component 1193, so as to push the locating element 119 to slide along the direction from the pressing component 1198 to the clamping component 1193, so that the clamping protrusion 1196 can automatically dodge the slide rail 1181 without manually pressing the pressing component 1198.

A limiting surface (not shown in the drawings) is also defined on a side of the clamping protrusion 1196 away from the guide surface 1197. When the clamping protrusion 1196 is inserted into the card slot 1182 of the slide rail 1181, the limiting surface of the clamping protrusion 1196 can be butted with an inner wall of the card slot 1182 to block the slide rail 1181. Wherein the limiting surface inclines outward along a direction from the clamping component 1193 to the pressing component 1198, or is parallel to the direction from the clamping component 1193 to the pressing component 1198, so that the limiting surface can have a better blocking effect on the slide rail 1181.

The accommodation hole 1192 is further defined by recessed from the end surface of the end of the connecting rod 1191 provided with the clamping component 1193. Wherein shapes of the connecting rod 1191 and the pressing component 1198 are both cylindrical, a diameter of the pressing component 1198 is greater than a diameter of the connecting rod 1191, and the accommodation hole 1192 is a cylindrical hole coaxial with the connecting rod 1191.

The guide groove 1171 defined on the guide element 117 penetrates the guide element 117 and is perpendicular to the length direction of the first frames 1151. a strip-shaped opening is defined by the guide groove 1171 on a surface of a side of the guide element 117 facing the first frames 1151, so that a cross-sectional shape of the guide element 117 is a U-shaped. The guide element 117 are also provided with two connecting components 1172, and the two connecting components 1172 are distributed on two opposite sides of the guide groove 1171, and a first fixing hole 1173 is defined on each of the two connecting components 1172.

The connecting plate 1154 extends along the length direction of the first frames 1151. A through second fixing hole 1157 is defined at a position of the connecting plate 1154 corresponding to the first fixing hole 1173. A fastening element pass through the second fixing hole 1157 and the first fixing hole 1173 from a side of the connecting plate 1154 facing the light outlet 1150 in sequence, so as to fixedly connect the connecting components 1172 with the connecting plate 1154. Wherein the fastening element includes screws, bolts, etc., which are not limited here.

In some embodiments, as shown in FIG. 2, one end of the chute 1152 is closed, and an entrance used for the slide rail 1181 to be inserted is defined on another end. The locating element 119 can be provided in a middle part of the chute 1152, or be provided close to an entrance of the chute 1152 or a closed end of the chute 1152. Of course, when the locating element 119 is provided close to the entrance of the chute 1152, it is more convenient to manually press the locating element 119.

In some embodiments, the card slot 1182 can be defined on the slide rail 1181 disposed on each of the two opposite ends of the bracket 118. In this way, when the bracket 118 is installed on the housing 11 by users, the bracket 118 can be installed on the housing 11 without distinguishing a positive direction and a negative direction (the users can install it at will without following a fixed direction), thereby enabling the locating element 119 to block the slide rail 1181 of the bracket 118.

Wherein two card slots 1182 can be defined on the slide rails 1181 disposed on each of the two opposite ends of the bracket 118, and the two card slots 1182 defined on each of the slide rails 1181 are both located at two ends of each of the slide rails 1181. Alternatively, the locating element 119 can also be provided in a middle part of the chute 1151, and a middle part of each of the two sliding rails 1181 is defined with one card slot 1182, respectively. When the user is performing an installation operation, the bracket 118 can be installed on the housing 11 without distinguishing a positive direction and a negative direction (the user can freely install it without following a fixed direction), thereby enabling the locating element 119 to block the slide rail 1181 of the bracket 118.

In addition, the card slot 1182 can be defined at two ends of one slide rail 1181, or only one card slot 1182 is defined on one slide rail 1181, which can also enable the clamping component 11 of the locating element 119 to be inserted into the card slot 1182 and to block the slide rail 1181. At this time, the positive direction and the negative direction (that is, the user must install it according to a fixed direction) of the bracket 118 need to be distinguished.

Figure 11:
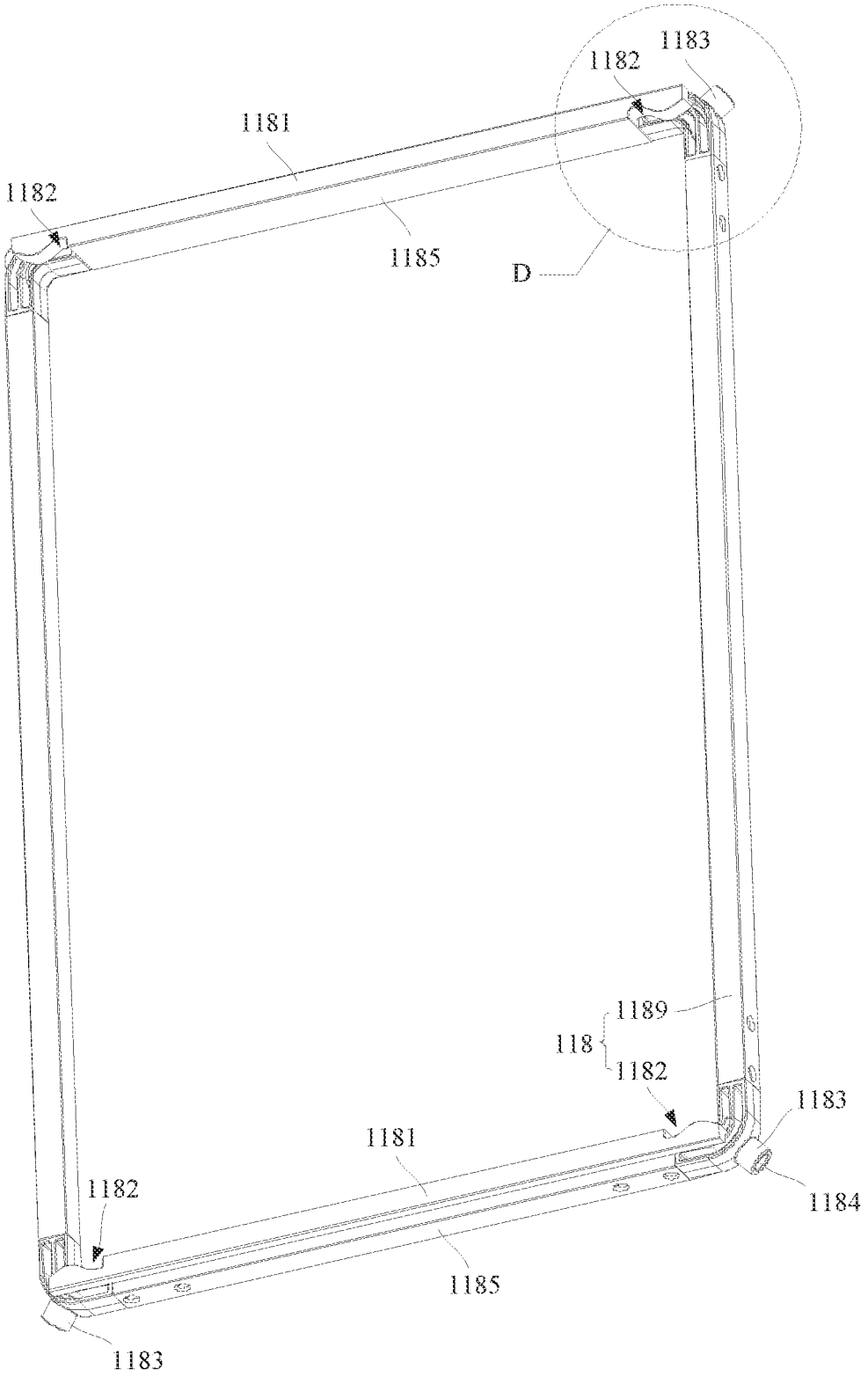
FIG. 11 is a schematic structural diagram of an embodiment of the bracket provided by the embodiment of the present application.
Figure 12:
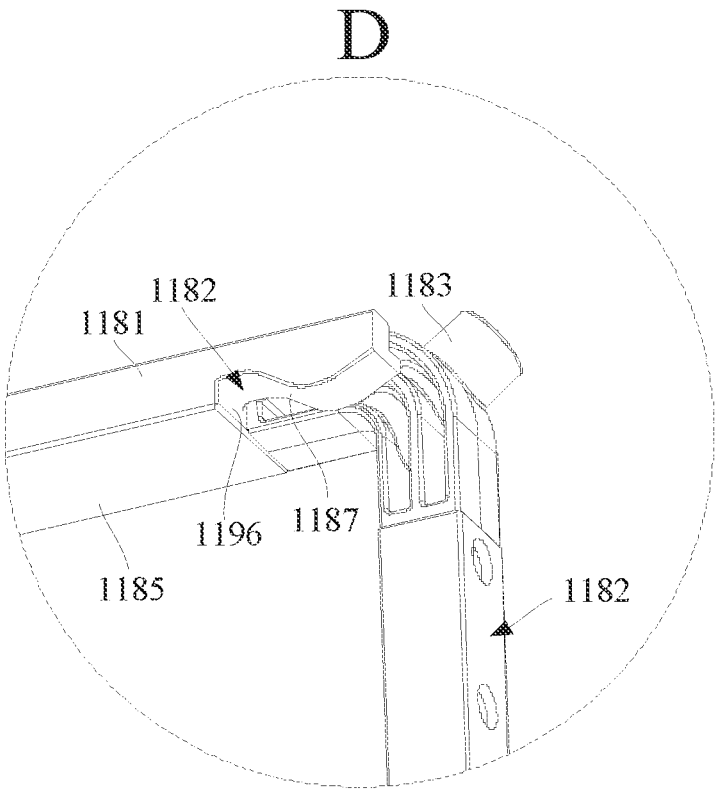
FIG. 12 is an enlarged view at a position of D in FIG. 11.

Specifically, as shown in FIG. 11 and FIG. 12, the bracket 118 is a rectangular frame, and two fixed slide rails 1181 are located on two opposite frame bars 1185, respectively; two ends of each of the slide rails 1181 disposed on the bracket 118 are both defined with the card slot 1182, the card slot 1182 is defined by recessed from a surface of the slide rails 1181 facing a side of the light outlet 1150. When the bracket 118 is installed on the housing 11 along a positive direction, the clamping component 1193 disposed on the locating element 119 will be inserted into the card slot 1182 corresponding to one of the slide rails 1181, so as to locate the one of the slide rails 11811; when the bracket 118 is rotated with an angle of 180° and is installed on an upper side in reverse, the clamping component 1193 disposed on the locating element 119 will be inserted into the clamping slot 1182 corresponding to another one of the slide rails 1181, so as to locate the another one of the slide rails 1181.

In addition, a butting surface 1186 is defined at a side of the card slot 1182 close to a middle part of the slide rails 1181. When the clamping component 1193 is inserted into the card slot 1182, the limiting surface of the clamping component 1193 is opposite to the butting surface 1186, and can be butted with the butting surface 1186, so as to prevent the slide rail 1181 of the bracket 118 from sliding. Wherein the butting surface 1186 is perpendicular to the length direction of the slide rail 1181, or an inclined direction of the butting surface 1186 is same as an inclined direction of the limiting surface, so as to improve a blocking effect of the clamping component 1193 on the slide rail 1181.

A side surface of the card slot 1182 opposite to the butting surface 1186 is an arc-shaped surface 1187. A distance between the arc-shaped surface 1187 and the butting surface 1186 gradually increases in a direction from a bottom part of the card slot 1182 to an opening of the card slot 1182. In a process of making the clamping protrusion 1196 exit from the card slot 1182 at an end of the slide rail 1181, and controlling the slide rail 1182 to slide outside the slide rail 1152, the clamping component 1193 will be inserted into the card slot 1182 defined at another end of the slide rail 1181 under an action of the elastic element 1194. At this time, the arc-shaped surface 1187 of the card slot 1182 defined at the another end of the slide rail 1181 will be butted with the clamping protrusion 1196, and the clamping protrusion 1196 will be squeezed, so that the clamping protrusion 1196 will slide along the direction from the pressing component 1198 to the clamping component 1193, so as to dodge the slide rail 1181, so that the slide rail 1181 can slide out of the chute 1152 smoothly.

In some embodiments, as shown in FIG. 11, the bracket 118 includes a support frame 1189 and an installing column 1183. The slide rail 1181 is arranged at two opposite ends of the support frame 1189, the installing column 1183 is connected to the support frame 1189, and the installing column 1183 is configured to be connected to the soften-light box, so that the bracket 118 can support the soften-light box.

As shown in FIG. 11, a shape of the support frame 1189 of the bracket 118 is rectangular, and four corners of the support frame 1189 are all provided with the installing column 1183. Four installing columns 1183 extend from the bracket 118 toward a side of the bracket 118 away from the housing 11. Installing holes 1184 are also defined on the installing columns 1183 extending along a length direction of the installing columns 1183. The soften-light box (not shown in the drawings) includes reflective cloth, soften-light cloth, and a support structure supporting the reflective cloth and the soften-light cloth. The support structure includes four support columns (not shown in the drawings), which are inserted into the installing holes 1184 of the four installing columns 1183, respectively, so that the soften-light box is fixedly connected to the bracket 118.

As shown in FIG. 2, FIG. 8, and FIG. 9, the diffuser installing frame 115 also includes two second frames 1155 disposed opposite to each other and connected between the two first frames 1151, and the two first frames 1151 and the two second frames 1155 are enclosed to define the light outlet 1150.

In some embodiments, a clamping groove 1156 is defined at a side of each of the two second frames 1155 facing the main housing 111, and the main housing 111 is provided with a clamping plate 1131 at a position corresponding to the clamping groove 1156. When the diffuser installing frame 115 is connected to the main housing 111, the clamping plate 1131 disposed on the main housing 111 is inserted into the clamping groove 1156 of the second frames 1155, so that the main housing 111 is firmly connected to the diffuser installing frame 115.

Figure 13:
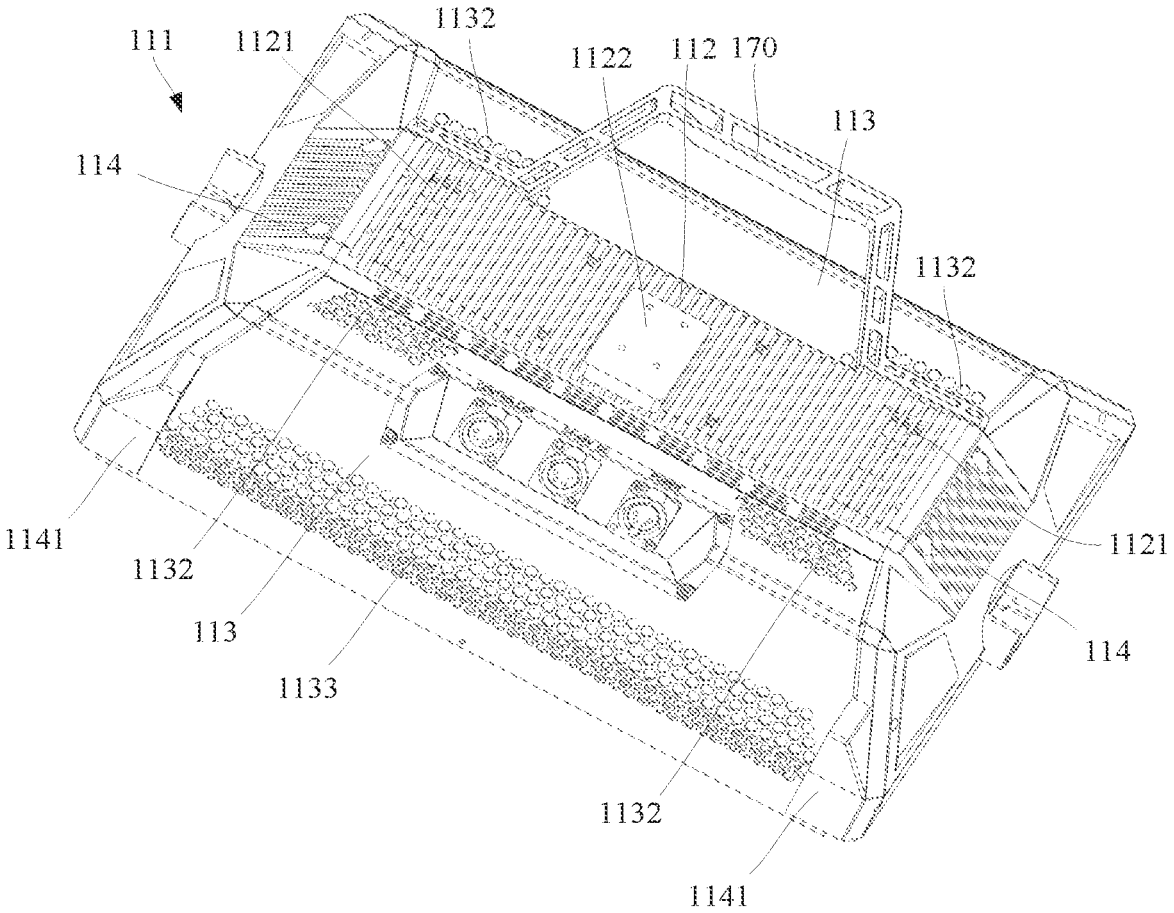
FIG. 13 is a schematic structural diagram of an embodiment of a main housing provided by the embodiment of the present application.

As shown in FIG. 3 and FIG. 13, the main housing 111 includes a back plate 112, two first side plates 113 and two second side plates 114 connected to a side of the back plate 112. The two first side plates 113 and two second side plates 114 are distributed around the back plate 112, and the two first side plates 113, two second side plates 114, and the back plate 112 are enclosed together to define a cavity 1111 accommodating the heat dissipation device 140 and the light source 130.

In some embodiments, the back plate 112 includes two opposite first sides and two opposite second sides, the two second sides are located between the two first sides, and two ends of the second side are connected to an end of the two first sides, respectively.

An edges of the two first side plates 113 close to the back plate 112 are connected to the two first sides of the back plate 112, respectively, edges of the two second sides close to the back plate 112 are connected to the two second sides, respectively, and side edges of the first side plates 113 and side edges of the second side plates 114 close to each other are connected together, so that the two first side plates 113, the two second side plates 114, and the back plate 112 are enclosed together to define the cavity 1111.

The clamping plate 1131 disposed on the main housing 111 is located at edges of the two first side plates 113 away from the back plate 112. When the diffuser installing frame 115 is installed on the main housing 111, the edges of the two first side plates 113 away from the back plate 112 are inserted into the clamping groove 1156 of the two second frames 1155, respectively, so that a connection between the main housing 111 and the diffuser installing frame 115 is more stable.

In some embodiments, the back plate 112 is defined with through first air inlets 1121, and each of the two first side plates 113 is defined with through second air inlets 1132, and the second air inlets 1132 defined on the first side plates 113 are defined close to the back plate 112. After the heat dissipation device 140 is installed in the main housing 111, the first air inlets 1121 and the second air inlets 1132 correspond to the air inlet of the airflow generating device 145, so that cold air outside the main housing 111 can quickly enter the main housing 111 through the first air inlets 1121 and the second air inlets 1132.

A side of the back plate 112 facing the heat dissipation device 140 is also provided with a power adapter 160. A number of first air inlets 1121 defined on the back plate 112 is two, and the two first air inlets 1121 are distributed at two ends of the back plate 112 along arrangement direction of the two second sides, so as to stagger the first air inlets 1121 and the power adapter 160, and prevent the power adapter 160 from blocking the first air inlets 1121.

In some embodiments, the first air inlets 1121 can be arranged as a mesh or honeycomb array.

Similarly, the second air inlets 1132 can be arranged in a grid or honeycomb array. Wherein the second air inlets 1132 can be arranged extending along an arrangement direction of the two second sides of the back plate 112, or a plurality of second air inlets 1132 can be distributed in sequence along the arrangement direction of the two second sides of the back plate 112, so as to increase an air inlet area of the second air inlets 1132. In addition, a certain distance exists among the first air inlets 1121, the second air inlets 1132, and the airflow generating device 145, which can effectively reduce a generation of air duct noise.

As shown in FIG. 3 and FIG. 13, the two first side plates 113 are defined with through air outlets 1133, the air outlets 1133 can be arranged in a grid or honeycomb array. The air outlets 1133 and the second air inlets 1132 are distributed in sequence along a direction away from the back plate 112. When the heat dissipation device 140 is installed in the main housing 111, the air outlets 1133 defined on the two first side plates 113 correspond to two ends of the fins 1431, wherein a length direction of the air outlets 1133 correspond to the arrangement direction of the fins 1431. For example, an arrangement length of the air outlet 1133 can be equal to or greater than an arrangement length of the fins 1431, which is conducive to flow of air, so that hot air blown from the two ends of the fins 1431 can be quickly distributed to outside of the main housing 111 through the air outlet holes 1133.

Wherein the air outlets 1133 can extend along the arrangement direction of the two second sides of the back plate 112, so as to increase an air outlet area of the air outlets 1133. In addition, the first air inlets 1121, the second air inlets 1132, and the air outlets 1133 can also be provided (for example, bonded or screwed) with a grid like protective screen (not shown in the drawings) towards an inside of the housing, so as to prevent impurities outside the main housing 111 from entering the main housing 111 through the first air inlets 1121, the second air inlets 1132, and the air outlets 1133.

In some embodiments, as shown in FIG. 13, an external surface of the back plate 112 is also provided with a fixing block 1122, the fixing block 1122 is used to connect to other support devices, so as to support the lighting device 10 on the support device. In addition, a handle 170 is also arranged on the outer surface of the back plate 112, so as to facilitate operators to move the lighting device 10.

In some embodiments, as shown in FIGS. 3 and 13, a side of the second side plates 114 close to the first sides extends toward the first sides to form an assembly plate 1141, and edges of the first side plates 113 close to the second side plates 114 are located at an inner side of the assembly plate 1141, so as to avoid an inconvenient connection between the first side plates 113 and the second side plates 114 caused by excessive segment differences (deviations or steps caused by a connection and a matching of adjacent components) at a connection position defined by the first side plates 113 and the second side plates 114. In addition, disposing the first side plates 113 on the inner side of the second side plates 114 can also effectively improve assembly efficiency.

As shown in FIG. 13, limiting plates 1142 can also be disposed on the sides of the second side plates 114 close to the first side plates 113. The edges of the first side plates 113 close to the second side plates 114 are located between the assembly plate 1141 and the limiting plates 1142, so that fits between the first side plates 113 and the second side plates 114 are more stable. Wherein a number of the limiting plates 1142 is multiple, and the multiple limiting plates 1142 are distributed in sequence along an extension direction of the assembly plate 1141.

As shown in FIG. 3, the lighting device 10 also includes a support frame 120, the support frame 120 is used to connect to the housing 11 and the heat dissipation device 140 of the lighting device 10, so as to support the housing 11 and the heat dissipation device 140.

In some embodiments, the support frame 120 includes support plates 122, and the support plates 122 are arranged in the housing 11. Both the heat dissipation device 140 and the housing 11 are fixedly connected to the support plates 122, so that the support plates 122 supports the housing 11 and the heat dissipation device 140, respectively. It can be understood that weights of the heat dissipation device 140 and the light source 130 (wherein a weight of the heat dissipation device accounts for a majority of an entire part of a weight of the lighting device) are heavy, if the heat dissipation device 140 and the light source 130 are directly disposed on the housing 11, the housing 11 may be crushed. In this embodiment, the support plates 122 are arranged on the housing 11, and the heat dissipation device 140 is fixedly connected to the support plates 122, so as to prevent the heat dissipation device 140 from directly pressing on the housing 11 and damaging the housing 11.

A number of support plates 122 is two, and the two support plates 122 are installed on the two second side plates 114 of the main housing 111, respectively. The substrate 141 of the heat dissipation device 140 is fixedly connected to the two support plates 122 close to two sides of the two second side plates 114, so as to make an installation of the heat dissipation plate 140 more stable.

In some embodiments, an intensity of the support plates 122 is greater than an intensity of the housing 11, so as to improve bearing capacity of the support plates 122. Specifically, the support plates 122 can be made of metal materials such as steel, iron, or alloy, etc, or can be made of other materials having a higher intensity and rigidity, and there is no restriction here. In addition, a thickness of the support plates 122 can be greater than a thickness of an inner wall of the housing 11, so as to improve the intensity of the support plates 122.

Specifically, as shown in FIG. 3, the support plates 122 extends along the length direction of the sides of the substrate 141 close to the second side plates 114, a lower surface of the support plates 122 is supported on an inner surface of the second side plates 114, and a side of the substrate 141 close to the second side plates 114 is supported on an upper surface of the support plates 122. Third fixing holes 1221 are defined on the support plates 122, fourth fixing holes 1413 are defined on the side of the substrate 141 close to the second side plates 114, and fifth fixing holes (not shown in the drawings) are also defined at a position of the second side plates 114 corresponding to the third fixing holes 1221. Screws pass through the fourth fixing holes 1413, the third fixing holes 1221, and the fifth fixing holes in sequence, so as to fixedly connect the heat dissipation device 140 and the housing 11 with the support plates 122, respectively.

In some embodiments, as shown in FIG. 3, the support frame 120 also includes a U-shaped bracket 121 located outside the housing 11. Two free ends of the U-shaped bracket 121 are rotationally connected to two support plates 122 through the two second sides 114, respectively. Therefore, the U-shaped bracket 121 supports the housing 11 and the heat dissipation device 140 through the support plates 122, respectively, and a gravity of the heat dissipation device 140 will not act on the housing 11, so as to avoid damage caused by insufficient bearing capacity of the housing 11.

Specifically, the support plates 122 extends along the length direction of the side of the substrate 141 close to the second side plates 114. A middle part of the support plates 122 passes through the second side plates 114 and is rotationally connected to the free ends of the U-shaped bracket 121. A surface of one side of the support plates 122 is fixedly connected to an inner surface of the second side plates 114, so as to support the second side plates 114, thereby supporting the entire housing 11. A surface of another side of the support plates 122 is fixedly connected to the two ends of the substrate 141 along the arrangement direction of the plurality of fins 1431, so as to support the substrate 141, thereby supporting the heat dissipation device 140 and the light source 130. It can be understood that the heat dissipation device 140 and the light source 130 (wherein the weight of the heat dissipation device 140 accounts for the majority of the whole weight of the lighting device 10) is supported by the support plates 122, thereby avoiding a direct bearing by the main housing 111. The support plates 122 further transfers gravity generated by the weight of the heat dissipation device 140 and the weight of the light source 130 on the housing 11 to the U-shaped bracket 121, thus effectively dispersing the gravity generated by the weight of the heat dissipation device 140 and the weight of the light source 130, thereby reducing damage to the housing 11.

In some embodiments, as shown in FIG. 3, the U-shaped bracket 121 is also provided with a knob 180, the knob 180 is used to control a rotation angle of the housing 11 relative to the U-shaped bracket 121. That is, when the knob is rotated in a certain direction (e.g. clockwise), the knob can be rotated relative to the support 121. At this time, an angle can be adjusted (that is, a luminous orientation angle of the lighting device 10 can be adjusted). After a required angle is adjusted, the knob 180 is rotated in an opposite direction (e.g. counterclockwise), so that the knob 180 can be fixed with the bracket 121; and at this time, the angle cannot be adjusted.

In some embodiments, as shown in FIG. 3, a middle part of the U-shaped bracket 121 is also fixedly connected to a support rod 1232, a shape of the support rod 1232 can be, for example, cylindrical. The U-shaped bracket 121 can be conveniently fixed by the support rod 1232.

Wherein a fixing component 123 can be arranged in the middle part of the U-shaped bracket 121. The fixing component 123 includes two fixing elements 1231 distributed on two sides of the support frame, and the two fixing elements 1231 are connected together by the connecting element, so as to clamp the middle part of the U-shaped bracket 121 between the two fixing elements 1231, so that the fixing component 123 is fixedly connected to the U-shaped bracket 121. The support rod 1232 is fixedly connected to the fixing elements 1231 located on a side of the U-shaped bracket 121 away from the main housing 111 of the fixing component 123, so as to make a connection between the support rod 1232 and the middle part of the U-shaped bracket 121 more stable.

One of the two fixing elements 1231 of the fixing component 123 is a plastic element, and another one is a hardware pressing element, so as to avoid a deformation of the U-shaped bracket 121 after the U-shaped bracket 121 is directly supported by the support rod 1232.

It can be understood that due to a large weight of the heat dissipation device 140 and the housing 11, gravity generated by the weight of the heat dissipation device 140 and the weight of the housing 11 is directly conducted to the U-shaped bracket 121 by the support plates 122. If the support rod 1232 is directly used to support, a contacting area between the support rod 1232 and the bracket 121 is small, which is easily to cause deformation at a position of a part connecting the U-shaped bracket 121 with the support rod 1232.

An embodiment of the present application also provides a lighting device, the lighting device includes a heat dissipation device. A side of a substrate of the heat dissipation device away from a plurality of fins is thermally connected to the light source. A specific structure of the heat dissipation device can refer to the above embodiments. Since the lighting device the present application adopts all technical solutions of all the above embodiments, it has at least all the beneficial effects brought by the technical solutions of the above embodiments, which will not be described here.

In the above embodiments, the description of each of the embodiments has its own emphasis. For the part not detailed in an embodiment, please refer to relevant description of other embodiments.

The heat dissipation device, the bracket, and lighting device provided by the embodiments of the present application are described in detail above. In this paper, specific examples are used to explain a principle and an implementation mode of the present application. The description of the above embodiments is only used to help understand a technical scheme and a core idea of the present application; those skilled in the art should understand that they can still modify the technical solutions recorded in the aforementioned embodiments, or equivalent replace some of the technical features; however, these modifications or substitutions do not make a nature of the corresponding technical solutions separate from the scope of the technical solutions of the embodiments of the present application.

What is claimed is:

1. A heat dissipation device, comprising:
- a substrate;
- a plurality of fins arranged on the substrate with certain gaps therebetween and connected to the substrate; and
- at least one airflow generating device disposed at an end of the plurality of fins away from the substrate, airflow generated by the airflow generating device flowing from at least a part of the gaps of the plurality of fins and along a direction toward the substrate, and the airflow being guided to diffuse through the substrate together with the plurality of fins,
- wherein at least one strip-shaped groove is defined by recessed from a side of the substrate away from the plurality of fins, the at least one strip-shaped groove extends along an arrangement direction of the plurality of fins, and a second heat dissipation pipe is provided in the at least one strip-shaped groove.

2. The heat dissipation device according to claim 1, wherein the heat dissipation device further comprises a baffle, the baffle is disposed on the end of the plurality of fins away from the substrate and covers at least a part of the plurality of fins; the airflow generating device is arranged on a side of the baffle away from the plurality of fins, and a through hole is defined at a position of the baffle corresponding to an air outlet of the airflow generating device.

3. The heat dissipation device according to claim 1, wherein a groove is defined on the end of the fins away from the substrate, the groove is located at a middle part of the fins in a length direction, and the at least one airflow generating device is provided in the groove.

4. The heat dissipation device according to claim 3, wherein the at least one airflow generating device comprises a plurality of airflow generating devices, and the plurality of airflow generating devices are distributed in sequence along an arrangement direction of the plurality of fins.

5. The heat dissipation device according to claim 1, wherein the heat dissipation device further comprises at least one first heat dissipation pipe, the at least one first heat dissipation pipe comprises a first section and a second section connected to each other and passing through the plurality of fins in sequence along a distribution direction of the plurality of fins, and the first section and the second section of the at least one first heat dissipation pipe are distributed in sequence along a direction from a middle part to an end of the fins.

6. The heat dissipation device according to claim 5, wherein the at least one first heat dissipation pipe comprises a plurality of first heat dissipation pipes, the plurality of first heat dissipation pipes are distributed in sequence along a length direction of the fins; a side surface of the first section of the at least one first heat dissipation pipe is attached to a side surface of the substrate.

7. The heat dissipation device according to claim 1, wherein the at least one strip-shaped groove comprises a plurality of strip-shaped grooves, the plurality of strip-shaped grooves are distributed in sequence along a length direction of the fins, and each of the plurality of strip-shaped grooves is provided with the second heat dissipation pipe.

8. An illumination device, wherein the illumination device comprises:
- a light source;
- a heat dissipation device, wherein the heat dissipation device further comprises:
  - a substrate;
  - a plurality of fins arranged on the substrate with certain gaps therebetween and connected to the substrate; and
  - at least one airflow generating device disposed at an end of the plurality of fins away from the substrate, airflow generated by the airflow generating device flowing from at least a part of the gaps of the plurality of fins and along a direction toward the substrate, and the airflow being guided to diffuse through the substrate together with the plurality of fins; and
- wherein a side of the substrate of the heat dissipation device away from the plurality of fins is thermally connected to the light source; and
- wherein at least one strip-shaped groove is defined by recessed from a side of the substrate away from the plurality of fins, the at least one strip-shaped groove extends along an arrangement direction of the plurality of fins, and a second heat dissipation pipe is provided in the at least one strip-shaped groove.

9. The illumination device according to claim 8, wherein the illumination device further comprises:

a housing, the light source and the heat dissipation device being accommodated in the housing; and a support plate disposed in the housing, both of the heat dissipation device and the housing being fixedly connected to the support plate.

10. The illumination device according to claim 8, wherein the heat dissipation device further comprises a baffle, the baffle is disposed on the end of the plurality of fins away from the substrate and covers at least a part of the plurality of fins; the airflow generating device is arranged on a side of the baffle away from the plurality of fins, and a through hole is defined at a position of the baffle corresponding to an air outlet of the airflow generating device.

11. The illumination device according to claim 8, wherein a groove is defined on the end of the fins away from the substrate, the groove is located at a middle part of the fins in a length direction, and the at least one airflow generating device is provided in the groove.

12. The illumination device according to claim 11, wherein the at least one airflow generating device comprises a plurality of airflow generating devices, and the plurality of airflow generating devices are distributed in sequence along an arrangement direction of the plurality of fins.

13. The illumination device according to claim 8, wherein the heat dissipation device further comprises at least one first heat dissipation pipe, the at least one first heat dissipation pipe comprises a first section and a second section connected to each other and passing through the plurality of fins in sequence along a distribution direction of the plurality of fins, and the first section and the second section of the at least one first heat dissipation pipe are distributed in sequence along a direction from a middle part to an end of the fins.

14. The illumination device according to claim 13, wherein the at least one first heat dissipation pipe comprises a plurality of first heat dissipation pipes, the plurality of first heat dissipation pipes are distributed in sequence along a length direction of the fins; a side surface of the first section of the at least one first heat dissipation pipe is attached to a side surface of the substrate.

15. The illumination device according to claim 8, wherein the at least one strip-shaped groove comprises a plurality of strip-shaped grooves, the plurality of strip-shaped grooves are distributed in sequence along a length direction of the fins, and each of the plurality of strip-shaped grooves is provided with the second heat dissipation pipe.

* * * * *